US011572225B2

(12) United States Patent
Wehrmann

(10) Patent No.: US 11,572,225 B2
(45) Date of Patent: Feb. 7, 2023

(54) ON-DEMAND INFLATABLE PACKAGING

(71) Applicant: Automated Packaging Systems, LLC, Streetsboro, OH (US)

(72) Inventor: Rick Steven Wehrmann, Hudson, OH (US)

(73) Assignee: Automated Packaging Systems, LLC, Streetsboro, OH (US)

( * ) Notice: Subject to any disclaimer, the term of this patent is extended or adjusted under 35 U.S.C. 154(b) by 365 days.

(21) Appl. No.: 16/864,213

(22) Filed: May 1, 2020

(65) Prior Publication Data

US 2020/0255177 A1 Aug. 13, 2020

Related U.S. Application Data

(63) Continuation of application No. 14/216,135, filed on Mar. 17, 2014, now Pat. No. 10,647,460.

(60) Provisional application No. 61/801,711, filed on Mar. 15, 2013.

(51) Int. Cl.

| | |
|---|---|
| ***B65D 81/03*** | (2006.01) |
| ***B31B 70/94*** | (2017.01) |
| ***B65D 81/05*** | (2006.01) |
| ***B65B 55/00*** | (2006.01) |
| ***B65B 55/20*** | (2006.01) |
| ***B31D 5/00*** | (2017.01) |
| *B31B 160/10* | (2017.01) |
| *B31B 155/00* | (2017.01) |

(52) U.S. Cl.

CPC ..... *B65D 81/03* (2013.01); *B31B 70/946* (2017.08); *B31D 5/0073* (2013.01); *B65B 55/00* (2013.01); *B65B 55/20* (2013.01); *B65D 81/052* (2013.01); *B31B 2155/00* (2017.08); *B31B 2155/0014* (2017.08); *B31B 2160/10* (2017.08); *Y10T 29/49826* (2015.01)

(58) Field of Classification Search

CPC ..... B31B 5/0073; B31B 2155/00; B31B 2155/0014; B31B 2160/10; B31B 70/946; B65D 81/02; B65D 81/03; B65D 81/05; B65D 81/052; B31D 5/0073

USPC ..... 206/522; 428/35.4, 36.6, 36.7

See application file for complete search history.

(56) References Cited

U.S. PATENT DOCUMENTS

| | | | |
|---|---|---|---|
| 2,153,214 | A | 4/1939 | Tondrean |
| 2,379,935 | A | 7/1945 | Seiferth et al. |
| 3,033,257 | A | 5/1962 | Weber |

(Continued)

FOREIGN PATENT DOCUMENTS

| | | | |
|---|---|---|---|
| EP | 597446 | A1 | 5/1994 |
| EP | 2143555 | A1 | 1/2010 |

(Continued)

*Primary Examiner* — Bryon P Gehman

(74) *Attorney, Agent, or Firm* — Jon M. Isaacson

(57) ABSTRACT

A packaging material includes a web of pouches and an outer skin. One panel of the web has an inflation pattern that is not inflated. The web has a continuous inflation channel that is in fluid communication with the inflation pattern. Each of the pouches of the web can be inflated by inflating the inflation pattern while the outer skin already attached to the outside of the web. The outer skin is attached to the web only along edge lines of the pouches. The outer skin is detached from the web between the edge lines of the pouches. The outer skin is attached to the outside of the web such that the continuous inflation pattern extends above the outer skin.

11 Claims, 16 Drawing Sheets

(56) References Cited

U.S. PATENT DOCUMENTS 3,254,820 A 6/1966 Lerner
3,254,828 A 6/1966 Lerner
3,298,156 A 1/1967 Lerner
3,319,685 A * 5/1967 Urban ..... B25H 5/00 383/3
3,358,823 A 12/1967 Paxton
3,359,703 A 12/1967 Quaadgras
3,389,534 A 6/1968 Pendelton
3,414,140 A 12/1968 Feldkamp
3,456,867 A 7/1969 Repko
3,462,027 A 8/1969 Puckhaber
3,477,196 A 11/1969 Lerner
3,501,085 A 3/1970 Dohmeier
3,523,055 A 8/1970 Lemelson
3,559,874 A 2/1971 Titchenal
3,575,757 A 4/1971 Smith
3,575,781 A 4/1971 Pezely
3,577,305 A 5/1971 Hines et al.
3,597,895 A 8/1971 Jensen
3,616,155 A 10/1971 Chavannes
3,618,286 A 11/1971 Membrino
3,650,877 A 3/1972 Johnson
3,660,189 A 5/1972 Troy
3,667,593 A 6/1972 Pendleton
3,699,746 A 10/1972 Titchenal
3,730,240 A 5/1973 Presnick
3,744,211 A 7/1973 Titchenal et al.
3,791,573 A 2/1974 Armstrong
3,795,163 A 3/1974 Armstrong et al.
3,802,974 A 4/1974 Emmel
3,808,981 A 5/1974 Shaw
3,813,845 A 6/1974 Weikert
3,817,017 A 6/1974 Titchenal
3,817,803 A 6/1974 Horsley
3,837,990 A 9/1974 Huffaker et al.
3,837,991 A 9/1974 Evans et al.
3,855,037 A 12/1974 Imhagen et al.
3,938,298 A 2/1976 Luhman et al.
3,939,995 A 2/1976 Baxter
3,941,306 A 3/1976 Weikert
3,960,062 A 6/1976 Leloux
4,014,154 A 3/1977 Lerner
4,017,351 A 4/1977 Larson
4,021,283 A 5/1977 Weikert
4,040,526 A 8/1977 Baxter et al.
4,044,693 A 8/1977 Ramsey, Jr.
4,076,872 A 2/1978 Lewicki et al.
4,096,306 A 6/1978 Larson
4,102,364 A 7/1978 Leslie
4,103,471 A 8/1978 Lowdermilk
4,146,069 A 3/1979 Angarola et al.
4,169,002 A 9/1979 Larson
4,214,024 A 1/1980 Jacobson
4,201,029 A 5/1980 Lerner
4,245,796 A 1/1981 Eglinton
4,259,134 A 3/1981 Joice et al.
4,284,221 A 8/1981 Nagel
4,306,656 A 12/1981 Dahlem
4,314,865 A 2/1982 Ottaviano
4,354,004 A 10/1982 Hughes et al.
4,380,484 A 4/1983 Repik et al.
4,493,684 A 1/1985 Bolton
4,498,894 A 2/1985 Kuckhermann
4,514,962 A 5/1985 Ausnit
4,518,654 A 5/1985 Eichbauer et al.
4,545,180 A 10/1985 Chung et al.
4,564,407 A 1/1986 Tsurata
4,576,669 A 3/1986 Caputo
4,597,244 A 7/1986 Pharo
4,598,421 A 7/1986 Jostler
4,616,472 A 10/1986 Owensby et al.
4,619,635 A 10/1986 Ottaviano
4,631,901 A 12/1986 Chung et al.
4,654,878 A 3/1987 Lems
4,664,577 A 5/1987 Bonali
4,676,376 A 6/1987 Kerswetter
4,787,755 A 11/1988 Branson
4,793,123 A 12/1988 Pharo
4,847,126 A 7/1989 Hiroshi et al.
4,874,093 A 10/1989 Pharo
4,901,506 A 2/1990 Weyandt
4,904,092 A 2/1990 Campbell et al.
4,918,904 A 4/1990 Pharo
4,922,687 A 5/1990 Chow et al.
4,931,033 A 6/1990 Leeds
4,945,714 A 8/1990 Bodolay et al.
4,969,310 A 11/1990 Lerner et al.
4,981,374 A 1/1991 Rutter et al.
5,034,450 A 7/1991 Betz
5,041,317 A 8/1991 Greyvenstein
5,060,801 A 10/1991 Vilas-Boas
5,064,408 A 11/1991 Bridgeman
5,070,675 A 12/1991 Chuan-Shiang
5,094,657 A 3/1992 Dworak et al.
5,117,608 A 6/1992 Nease et al.
5,141,494 A 8/1992 Danforth et al.
5,181,614 A 1/1993 Watts
5,187,917 A 2/1993 Mykleby
5,188,691 A 2/1993 Caputo
5,203,761 A 4/1993 Reichental et al.
5,210,993 A 5/1993 van Boxtel
5,216,868 A 6/1993 Cooper et al.
5,257,492 A 11/1993 Watts
5,272,856 A 12/1993 Pharo
5,289,671 A 3/1994 Lerner
5,307,969 A 5/1994 Menendez
5,340,632 A 8/1994 Chappuis
5,351,828 A 10/1994 Becker et al.
5,383,837 A 1/1995 Watts
5,394,676 A 3/1995 Lerner
5,427,294 A 6/1995 VandenHeuvel
5,454,642 A 10/1995 Deluca
5,468,525 A 11/1995 Watts
5,470,300 A 11/1995 Terranova
5,549,233 A 8/1996 Clauser
5,552,003 A 9/1996 Hoover et al.
5,651,237 A 7/1997 Deluca
5,687,549 A 11/1997 Jostler et al.
5,693,163 A 12/1997 Hoover et al.
5,699,653 A 12/1997 Hartman et al.
5,704,192 A 1/1998 Jostler et al.
5,722,218 A 3/1998 Lerner
5,733,045 A 3/1998 Jostler et al.
5,743,070 A 4/1998 Lerner
5,752,666 A 5/1998 Simhaee
5,755,328 A 5/1998 Deluca
5,784,861 A 7/1998 Kotsiopoulos
5,810,200 A 9/1998 Trokhan
5,824,392 A 10/1998 Gotoh et al.
5,826,723 A 10/1998 Jaszai
5,857,571 A * 1/1999 Tschantz ..... B65D 81/052 383/3
5,921,390 A 7/1999 Simhaee
5,941,053 A 8/1999 Kotsiopoulos
5,944,424 A 8/1999 Lerner et al.
5,961,020 A 10/1999 Schmidt
5,987,856 A 11/1999 Lerner
5,996,319 A 12/1999 Lerner et al.
RE36,501 E 1/2000 Hoover et al.
6,010,090 A 1/2000 Bushmaker et al.
6,015,047 A 1/2000 Greenland
6,015,357 A 1/2000 Rizza
6,055,796 A 5/2000 Lerner et al.
RE36,759 E 7/2000 Hoover et al.
6,116,000 A 9/2000 Perkins et al.
6,170,239 B1 1/2001 Lerner
6,199,349 B1 3/2001 Lerner
6,206,262 B1 3/2001 Achelphol
6,209,286 B1 4/2001 Perkins et al.
6,213,167 B1 4/2001 Greenland
6,228,454 B1 5/2001 Johnson et al.
6,282,716 B1 9/2001 Patterson et al.
6,367,975 B1 4/2002 Cronauer et al.
6,410,119 B1 6/2002 Deluca et al.

(56) References Cited

U.S. PATENT DOCUMENTS 6,423,166 B1 7/2002 Simhaee
6,447,864 B2 9/2002 Johnson et al.
6,460,313 B1 10/2002 Cooper
6,488,222 B1 12/2002 West et al.
6,499,278 B2 12/2002 Cronauer et al.
6,519,916 B1 2/2003 Brown
6,520,332 B1 * 2/2003 Barmore ..... B65D 81/052 206/499
6,527,147 B2 3/2003 Wehrmann
6,536,624 B2 3/2003 Johnson et al.
6,543,201 B2 4/2003 Cronauer et al.
6,550,229 B2 4/2003 Sperry et al.
6,565,946 B2 5/2003 Perkins et al.
6,569,283 B1 5/2003 Sperry et al.
6,582,800 B2 6/2003 Fuss et al.
6,609,644 B1 8/2003 Menna
6,625,956 B1 9/2003 Soudan
D480,646 S 10/2003 Borchard et al.
D480,971 S 10/2003 Deluca et al.
6,635,145 B2 10/2003 Cooper
6,651,406 B2 11/2003 Sperry et al.
6,659,150 B1 12/2003 Perkins et al.
6,672,037 B2 1/2004 Wehrmann
6,688,346 B2 2/2004 Brahier et al.
6,696,127 B1 2/2004 Wehrmann
D490,711 S 6/2004 Deluca et al.
6,742,317 B2 6/2004 Cronauer et al.
6,751,926 B1 6/2004 Cooper
6,755,568 B2 6/2004 Malone et al.
6,761,960 B2 7/2004 Deluca et al.
6,786,022 B2 9/2004 Fuss et al.
6,871,755 B2 3/2005 DeVries
6,889,739 B2 5/2005 Lerner et al.
6,899,621 B2 5/2005 Behm
6,932,258 B1 8/2005 Roberts
6,946,044 B2 9/2005 Lorsch
6,948,296 B1 9/2005 Lerner et al.
6,952,910 B1 10/2005 Lorsch
6,955,846 B2 10/2005 Lerner
D512,311 S 12/2005 Deluca et al.
D513,182 S 12/2005 Deluca et al.
7,032,774 B2 4/2006 Boehm
7,059,794 B2 6/2006 Weeks
7,125,463 B2 10/2006 Lerner et al.
7,165,375 B2 1/2007 O'Dowd
7,223,462 B2 5/2007 Perkins et al.
7,297,387 B2 11/2007 Koyanagi
7,331,542 B2 2/2008 Coffiadiferro et al.
7,467,738 B2 12/2008 Woods
7,513,090 B2 4/2009 Wehrmann
7,533,772 B2 5/2009 Yoshifusa et al.
7,540,125 B2 6/2009 Lindquist
7,550,191 B2 6/2009 Lerner
7,552,257 B2 6/2009 Becker et al.
7,552,571 B2 6/2009 Lerner et al.
D596,031 S 7/2009 Wehrmann
7,571,584 B2 8/2009 Lerner
7,578,333 B2 8/2009 Greenwood et al.
D599,118 S 9/2009 Wehrmann
7,603,830 B2 10/2009 Nowakowski
7,607,911 B2 10/2009 Sperry et al.
D603,705 S 11/2009 Wehrmann
7,621,810 B2 11/2009 Gilmore
7,665,394 B2 2/2010 Roberts
7,694,495 B2 4/2010 Wehrmann
7,712,287 B2 5/2010 Gallimore
7,718,028 B2 5/2010 Lerner et al.
7,757,459 B2 7/2010 Wehrmann
7,767,288 B2 8/2010 Lerner
D630,945 S 1/2011 Wehrmann
D633,792 S 3/2011 Wehrmann
7,897,219 B2 3/2011 Wehrmann
7,897,220 B2 3/2011 Wehrmann
7,950,433 B2 5/2011 Sperry et al.
7,975,457 B2 7/2011 Wehrmann
D646,972 S 10/2011 Wehrmann
8,038,348 B2 10/2011 Lerner
8,061,110 B2 11/2011 Wetsch
8,128,770 B2 3/2012 Wetsch et al.
8,276,797 B2 10/2012 Dwyer
8,307,617 B2 11/2012 Riccardi et al.
8,354,150 B2 1/2013 Wehrmann et al.
8,357,439 B2 1/2013 Wehrmann
8,425,994 B2 4/2013 Wehrmann
8,745,960 B2 6/2014 Kannankeril et al.
9,205,622 B2 12/2015 Wehrmann
9,266,300 B2 2/2016 Chuba
9,283,729 B2 3/2016 Wehrmann et al.
9,550,339 B2 1/2017 Wehrmann et al.
10,377,098 B2 8/2019 Chuba et al.
10,464,122 B2 11/2019 Blacket et al.
2001/0000719 A1 5/2001 Lerner
2001/0000737 A1 5/2001 Johnston et al.
2001/0013215 A1 8/2001 Fuss et al.
2001/0014980 A1 8/2001 Patterson et al.
2002/0092279 A1 1/2002 Sperry et al.
2002/0108697 A1 8/2002 Perkins et al.
2002/0150730 A1 10/2002 Deluca et al.
2002/0155246 A1 10/2002 Johnson et al.
2002/0174629 A1 11/2002 Cronauer et al.
2003/0051440 A1 3/2003 Chow et al.
2003/0089082 A1 5/2003 Fuss et al.
2003/0094395 A1 5/2003 Peper et al.
2003/0010936 A1 6/2003 Lerner et al.
2004/0000581 A1 1/2004 Brandolini et al.
2004/0154728 A1 8/2004 Selle et al.
2004/0173073 A1 9/2004 Wilkes
2004/0216429 A1 11/2004 Tanaka et al.
2004/0232031 A1 11/2004 Nish et al.
2004/0265523 A1 12/2004 Koyanagi et al.
2005/0221059 A1 10/2005 Matarasso
2005/0266189 A1 12/2005 Wehrmann
2006/0042191 A1 3/2006 Lerner
2006/0086064 A1 4/2006 Wehrmann
2006/0090421 A1 5/2006 Sperry
2006/0218879 A1 10/2006 Garceau et al.
2006/0218880 A1 10/2006 Sperry et al.
2006/0262997 A1 11/2006 Hershey et al.
2007/0017978 A1 1/2007 Ho
2007/0054074 A1 3/2007 Wehrmann
2007/0054075 A1 3/2007 Wehrmann
2007/0084322 A1 4/2007 Williams
2007/0100076 A1 5/2007 Hayes
2008/0022630 A1 1/2008 Fuss et al.
2008/0066852 A1 3/2008 Wetsch et al.
2009/0110864 A1 4/2009 Wehrmann
2009/0293427 A1 12/2009 Lerner et al.
2010/0221466 A1 9/2010 Wehrmann
2010/0281828 A1 11/2010 Wehrmann
2010/0282824 A1 11/2010 Kannankeril et al.
2011/0062045 A1 * 3/2011 Kim ..... A45C 13/02 206/522
2011/0165352 A1 7/2011 Wehrmann
2011/0167772 A1 7/2011 Piucci
2012/0084999 A1 4/2012 Davis et al.
2012/0214658 A1 8/2012 Chuba
2013/0011510 A1 1/2013 Chuba
2013/0032293 A1 2/2013 Birkle
2013/0067860 A1 3/2013 McDonald
2013/0172165 A1 7/2013 Hamm et al.
2014/0260094 A1 5/2014 Wehrmann

FOREIGN PATENT DOCUMENTS

GB 2384459 7/2003
JP 57-55805 4/1982
JP S61115805 A 6/1986
JP 63067936 11/1990
JP H03162231 A 7/1991
JP H0749680 A 2/1995
JP 07285581 10/1995
JP 2000062793 2/2000
JP 2003002368 1/2003
JP 2006069641 A1 3/2006

(56) References Cited

FOREIGN PATENT DOCUMENTS

| | | | |
|---|---|---|---|
| JP | 4504462 | B1 | 7/2010 |
| JP | 201125981 | | 2/2011 |
| JP | 5469484 | B2 | 4/2014 |
| WO | 00/71423 | | 11/2000 |
| WO | 01/85434 | | 11/2001 |
| WO | 2005118408 | | 12/2005 |
| WO | 2007070240 | | 6/2007 |
| WO | 200958749 | | 5/2009 |
| WO | 2010109727 | A1 | 9/2010 |
| WO | 2013022398 | A1 | 2/2013 |

* cited by examiner

ON-DEMAND INFLATABLE PACKAGING

CROSS-REFERENCE TO RELATED APPLICATIONS

This application is a continuation of U.S. patent application Ser. No. 14/216,135, filed Mar. 17, 2014, which claims the benefit of U.S. Provisional Patent Application No. 61/801,711, filed Mar. 15, 2013, the entire disclosures of which are incorporated herein by reference in their entirety, to the extent that they do not conflict with the present application.

BACKGROUND

Bubble wrap is a widely-used packaging material. One known use of bubble wrap is as a cushioning material, for example, wrapped around a product or within a larger package, such as within corrugate, a bag, or paper. For example, cushioning material is used within the inside of a paper skin as a padded envelope.

A typical padded envelope includes cushioning material formed by a vacuum process. After the two layers of plastic are laminated or sealed together, a small amount of air is trapped within each bubble to create a cushioning characteristic.

Conventionally, a padded envelope is manufactured at assembly site. At the assembly site, the cushioning material is formed and attached to the paper skin. The envelope may be shipped to a point of retail sale, or a product may be packed within the padded envelope at a packing site. In either example, the padded envelopes are shipped in a final size and volume, i.e., with the inflation pattern fully inflated.

SUMMARY

The present application describes a method of assembly for on-demand inflatable packaging.

In an exemplary embodiment, a method for converting a web to on-demand inflatable packaging may include moving the web along a path of travel, attaching an outer skin to the outside of the web, and packaging the web into a non-inflated and stored configuration. The method may include moving the web along a path of travel, depositing at least one product into each of a plurality of the preformed pouches, and inflating each of the preformed pouches to form a cushioning material.

Further features and advantages of the invention will become apparent from the following detailed description made with reference to the accompanying drawings.

BRIEF DESCRIPTION OF THE DRAWING

Features and advantages of the general inventive concepts will become apparent from the following detailed description made with reference to the accompanying drawings.

DETAILED DESCRIPTION

Figure 1:
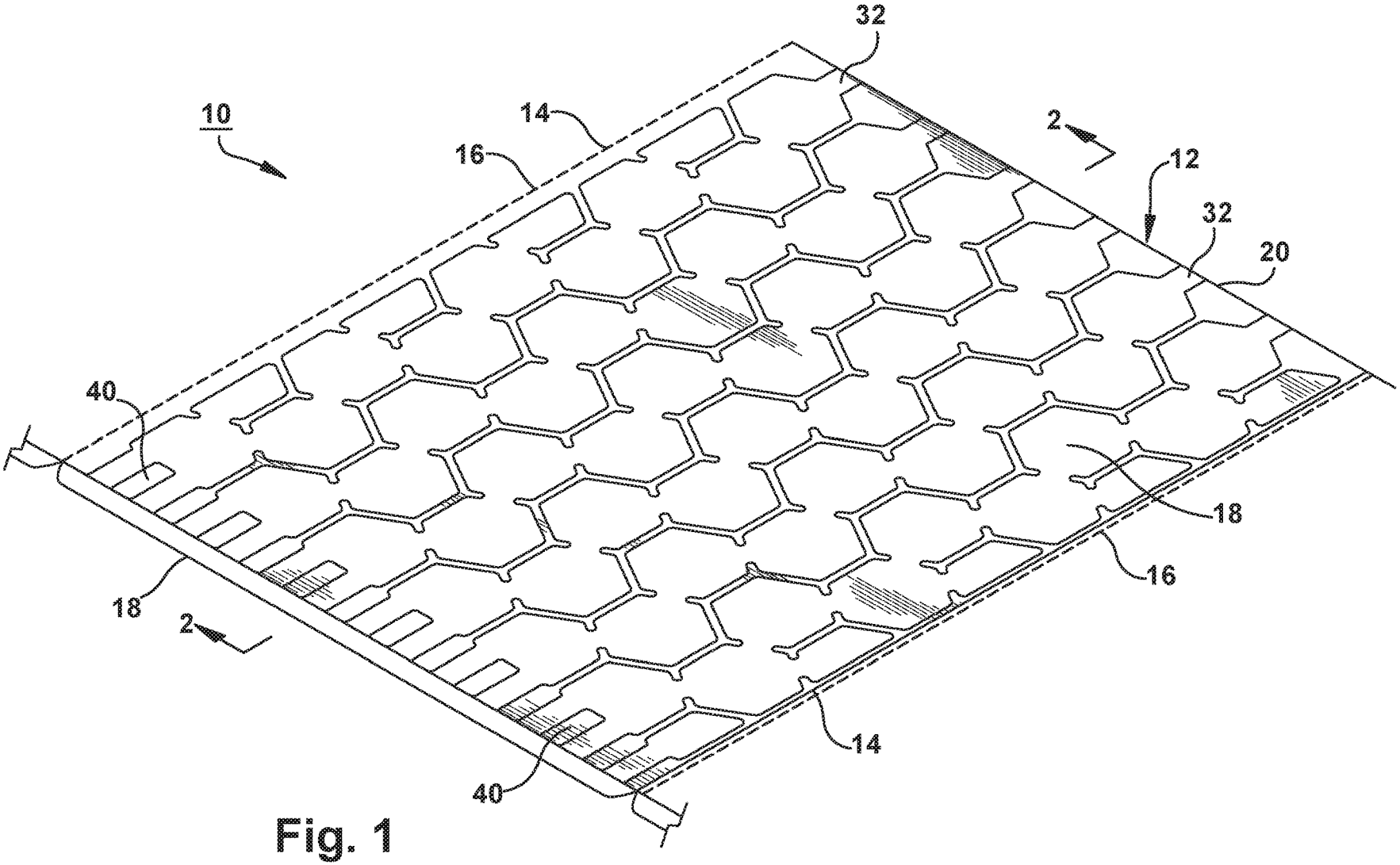
FIG. 1 is a perspective view of an exemplary embodiment of an inflatable packaging web.

This Detailed Description merely describes exemplary embodiments in accordance with the general inventive concepts and is not intended to limit the scope of the invention or the claims in any way. Indeed, the invention as described by the claims is broader than and unlimited by the exemplary embodiments set forth herein, and the terms used in the claims have their full ordinary meaning.

The general inventive concepts will now be described with occasional reference to the exemplary embodiments of the invention. This general inventive concept may, however, be embodied in different foul's and should not be construed as limited to the embodiments set forth herein. Rather, these embodiments are provided so that this disclosure will be thorough and complete, and will fully convey the scope of the general inventive concepts to those skilled in the art.

Unless otherwise defined, all technical and scientific terms used herein have the same meaning as commonly understood by one of ordinary skill in the art encompassing the general inventive concepts. The terminology set forth in this detailed description is for describing particular embodiments only and is not intended to be limiting of the general inventive concepts. As used in this detailed description and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, percentages and so forth as used in the specification and claims are to be understood as being modified in all instances by the term "about." Accordingly, unless otherwise indicated, the numerical properties set forth in the specification and claims are approximations that may vary depending on the suitable properties sought to be obtained in embodiments of the present invention. Notwithstanding that the numerical ranges and parameters setting forth the broad scope of the general inventive concepts are approximations, the numerical values set forth in the specific examples are reported as precisely as possible. Any numerical values, however, inherently contain certain errors necessarily resulting from error found in their respective measurements.

When discussing the invention, a final packaging product is discussed. For exemplary purposes, a padded mailer envelope is discussed. However, it should be apparent to one with ordinary skill in the art, that the invention may be practiced with other packaging products, such as for example, paper or plastic bags, paper or plastic mailers, corrugate mailers, and other know packaging offerings in which the inside of the package may be lined with a cushioning material.

The invention is directed to a method of producing on-demand inflatable packaging. The packaging would include a web of preformed pouches being defined by side edges and two panels. At least one panel has an inflation pattern and an outer skin may be attached to the outside of the web, or an outside surface of the panels may be smooth to act as an outer skin. The packaging would be inflatable at a later time for assembly of a padded envelope, either with or without a product being deposited in the preformed pouch, and the product being deposited before or after the preformed pouch is inflated.

The inventive assembly of the on-demand inflatable packaging allows the inflating of the padded envelope to be delayed, such as for example, until the end-user of the envelope deposits a product into the pouch. After the web is inflated, the padded envelope is separated from the web. This method allows more padded envelopes, in a non-inflated condition, to be shipped having a specific volume and weight, as compared to inflated padded envelopes. Also, a final user of the padded envelopes, such as a packer of a product, may produce only the amount of inflated padded envelopes needed for a certain packaging run, and thus enjoy the efficiencies of just-in-time production and reduction of envelope inventory.

In one embodiment of the invention, a method converts a web of preformed pouches to on-demand inflatable packaging. The pouches are defined by side edges, two panels, and at least one panel having an inflation pattern. The method includes moving the web along a path of travel, attaching an outer skin to the outside of the web, and packaging the web into a non-inflated and stored configuration. The web may be at least partially deflated and flattened before packaging. At the same or another location, the method may include moving the web along a path of travel, inflating each of the preformed pouches, and sealing each of the preformed pouches to form a cushioning material. In this condition, the two panels of each pouch are positioned to define an open end of the pouch and a closed end of the pouch.

After the cushioning material is formed, the method may include closing each of the preformed pouches, sealing the outer skin in a closed position around each of the preformed pouches, and separating the web into a plurality of padded envelopes. The preformed pouches may be closed before the outer skin is closed, or the preformed pouches and the outer skin may be closed at the same time. The outer skin may be attached to the web by heat sealing, during the edge line perforation process, or any known technique. In one embodiment, the outer skin is attached to the web at edge lines of the preformed pouches and unattached at areas between the edge lines of the preformed pouches. In another embodiment, the outer skin is attached to the web at areas between the edge lines of the preformed pouches.

In another embodiment, at least one product is deposited into each of a plurality of the preformed pouches. This embodiment includes inflating each of the preformed pouches, either before or after the product is deposited, sealing each of the preformed pouches to form a cushioning material, closing each of the preformed pouches, sealing the outer skin in a closed position around each of the plurality of the preformed pouches, and separating the web into a plurality of padded envelopes. The preformed pouches may be closed before the outer skin is closed, or the preformed pouches and the outer skin may be closed at the same time.

In another embodiment, a method of assembly for on-demand inflatable packaging includes an intermediate sealing of the outer skin, and after a time in storage, separating the outer skin. The method includes moving the web along a path of travel, attaching an outer skin to the outside of the web, sealing the outer skin in a closed position on the outside of the web, and packaging the web into a non-inflated and stored configuration. In this stored configuration, an amount of on-demand inflatable packaging, transferrable into a given number of envelopes, is storable in a smaller volume than the same number of fully inflated envelopes.

The method may further include moving the web along a web of travel, separating the outer skin open to thereby open the preformed pouches for inflation, and inflating the preformed pouches. After inflation, the preformed pouches are sealed to form a cushioning material. The method may further include sealing the outer skin in a closed position on the outside of the web and separating the web into a plurality of padded envelopes, or depositing at least one product into each of a plurality of the preformed pouches, sealing the outer skin in a closed position on the outside of the web, and separating the web into a plurality of padded envelopes.

When the intermediate sealed skin is separated to an open position, the sealed skin may form flaps on either side of the preformed pouch opening. Further, the method may include forming sealable flaps on either side of the preformed pouches after cutting the outer skin open to thereby open the preformed pouches for inflation forms sealable flaps, pulling the sealable flaps open in opposing directions, and depositing at least one product into each of a plurality of the preformed pouches.

After depositing, the method may include closing each of the preformed pouches, sealing the outer skin in a closed position around each of the preformed pouches, and cutting the web into a plurality of padded envelopes. The preformed pouches may be closed before the outer skin is closed, or the preformed pouches and the outer skin may be closed at the same time.

Another embodiment of the invention is preformed and inflatable pouches for manufacture into a plurality of padded envelopes. The pouches include a web of pouches being defined by side edges, two panels, and at least one panel having an inflation pattern, an outer skin attached to the outside of the web. The web is packaged into a non-inflated and stored configuration.

The outer skin may be attached to the web at edge lines of each pouch and unattached at areas between the edge lines of the pouches, or the outer skin may be attached to the web at areas between the edge lines of the pouches. In the non-inflated and stored configuration, the outer skin may be sealed in a closed position on the outside of the web with the two panels of each pouch open to define an open end and a closed end.

The web of preformed pouches may be of a variety of forms in the practice of the invention. The web may be an inflatable cushioning material designed to be inflated initially, flattened, and re-inflated at a later time by an end user and used as a wrapping material. An exemplary material is FASTWRAP™, manufactured and marketed by Automated Packaging Systems of Streetsboro, Ohio, and described in U.S. Pat. No. 6,423,166, which is incorporated herein by reference in its entirety. The end user inflates this material on-demand and inflates only the amount of wrapping material that is required at that time. A method of producing the preformed pouches is discussed herein.

The outer skin may be made of any thin material of suitable strength. Exemplary materials for the outer skin include paper and plastic and the material may be printable. For example, a plastic skin may be imprinted with indicia, such as for example, trademark information, product measurements, instructions, and bar coding data. The outer skin remains sufficiently smooth after all manufacturing steps, such as for example, initial inflation, flattening, and re-inflation, so that the bar coding is readable by a scanner.

The outer skin may be sealed on all four sides around the perimeter of the preformed pouch. If the end user of the on-demand inflatable packaging produces packaging as an end product, such as for example, padded mailing envelopes, the outer skin may be sealed on only three sides around the perimeter of the envelope to allow for depositing of a product. The open side may include user sealable features, such as for example, a removable strip which temporarily protects an adhesive strip.

Figure 2:
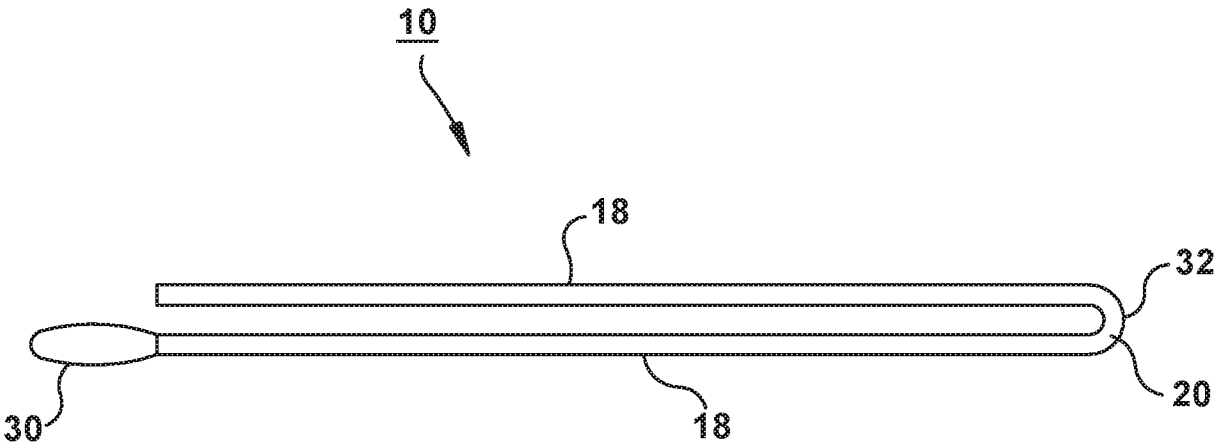
FIG. 2 is a sectional view of the packaging web of FIG. 1, shown along the line 2-2 of FIG. 1.

Referring now to the drawings, FIGS. 1 and 2 illustrate an exemplary embodiment of an inflatable packaging web 10. An exemplary web is made of one or more layers of plastic film. The packaging web 10 includes a string of side connected inflatable pouches 12. A single pouch is shown in FIG. 1, but the web 10 includes an indeterminate length of inflatable pouches 12. Each inflatable pouch is connected to one another at side edges 14. The exemplary side edges shown include lines of perforations 16 to facilitate separation of the finished product. Each pouch 12 includes at least one inflatable panel 18. The inflatable panel can take a wide variety of different forms. In exemplary embodiments, the panels 18 may be at least partially inflated, at least partially flattened, and then fully inflated. The panels may be made from the web disclosed in U.S. Pat. No. D596,031 or the web disclosed in U.S. Pat. No. 6,423,166, each of which are incorporated herein by reference in their entirety.

An exemplary web of on-demand inflatable packaging includes two or more pouches. Each pouch 12 is formed by sealing a pair of panels 18 together along a bottom edge 20 and side edges 14 or by folding a larger panel in half along the bottom edge and sealing the side edges together. One or both of the panels include an inflation pattern 512 (see FIG. 5). One or both of the panels 18 include an inflation channel 30. The inflation channel allows the preformed pouch to be inflated by a nozzle inserted into the channel 30.

In the illustrated embodiment in FIG. 2, only one inflation channel 30 is included and the two panels of the pouch are in fluid communication, such that inflation of one of the panels inflates the other panel. For example, in the illustrated embodiment passages 32 connect the air pockets 34 (see FIG. 3) at the bottoms of the panels to one another such that inflation through the inflation channel 30 causes inflation of both panels. The inflation channel 30 may be as described by any one or more of U.S. Pat. Nos. 6,423,166; 8,357,439; D646,972, 8,038,348, each of which are incorporated herein by reference in their entirety.

Figure 3:
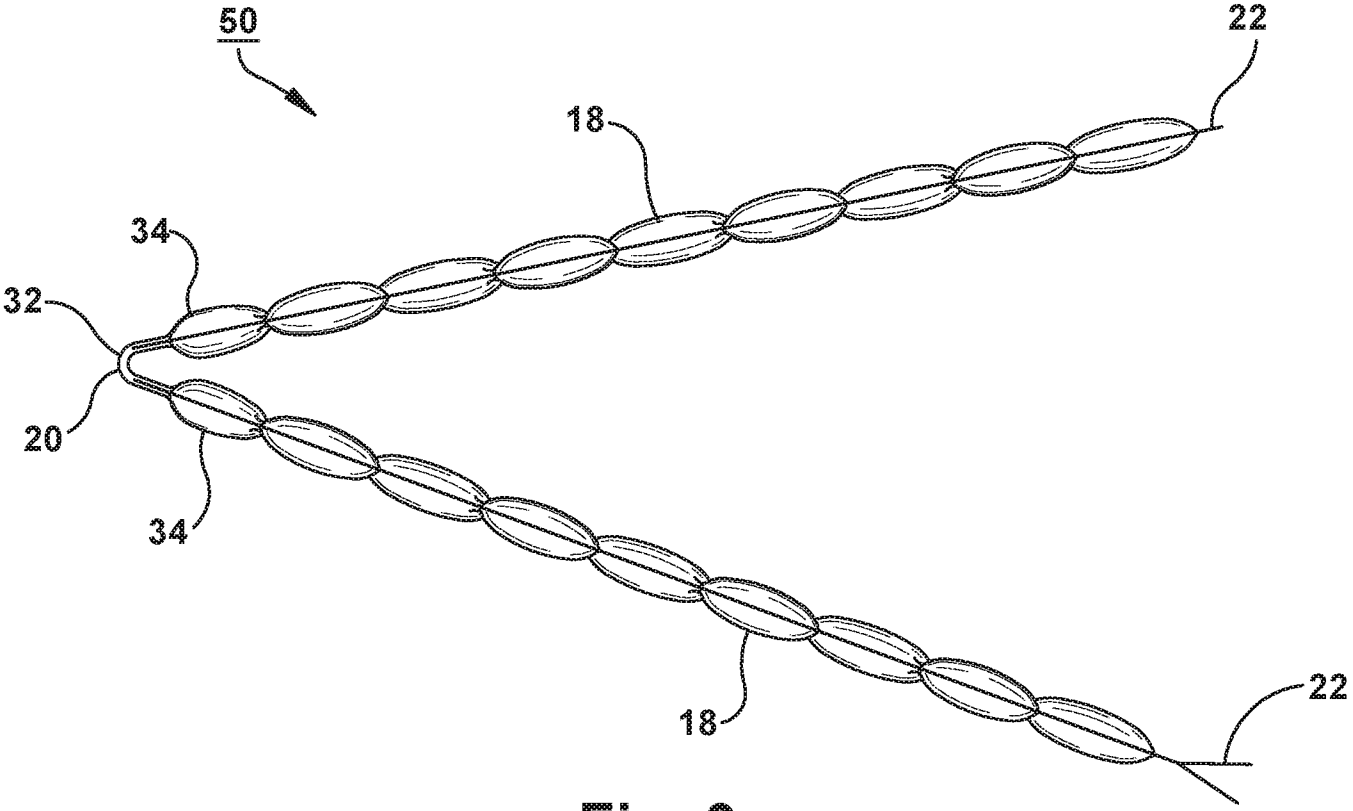
FIG. 3 is a side view of another exemplary embodiment of an inflatable packaging web, showing a pouch in an inflated condition.
Figure 4:
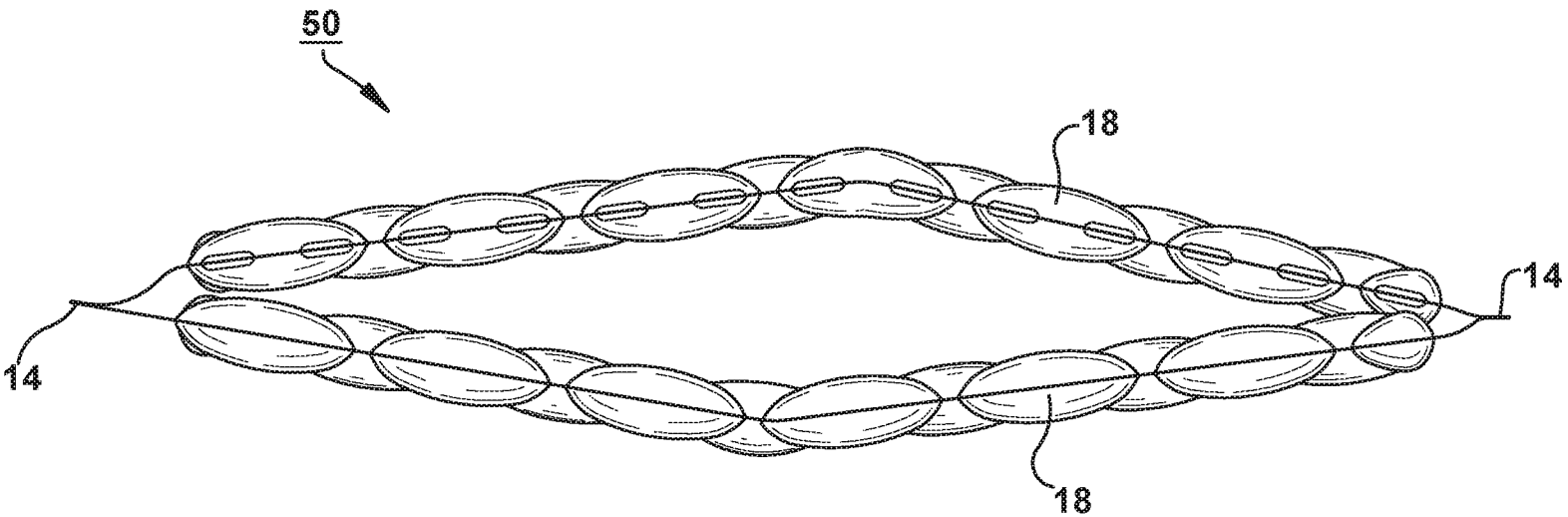
FIG. 4 is a side view of the pouch of FIG. 3, showing the pouch in a closed position.

The web of preformed pouches may be inflated to produce cushioning material. The pouch may be inflated and sealed in a first step to maintain the cushioning material, and then closed to create a closed pouch. For example, FIGS. 3 and 4 illustrate a pouch 12 of the web in an inflated condition. The web 10 is inflated through the inflation channel 30 and sealed across seals 40 to form the inflated pouches 50. The inflatable web of pouches 10 can be inflated and sealed in a wide variety of different ways. For example, the web 10 can be inflated and sealed in the any one of the manners disclosed by U.S. Pat. Nos. 8,357,439, 8,038,348, 7,513,090 and Published Application No. 2009/029342, each of which are incorporated herein by reference in their entirety. As can be seen from FIG. 3, the panels 18 of the inflated pouch are connected (either by sealing or folding) at the bottom of the pouch. As can be seen from FIG. 4, the panels 18 are sealed together at the side edges 14 to close the inflated pouch 50.

Figure 5:
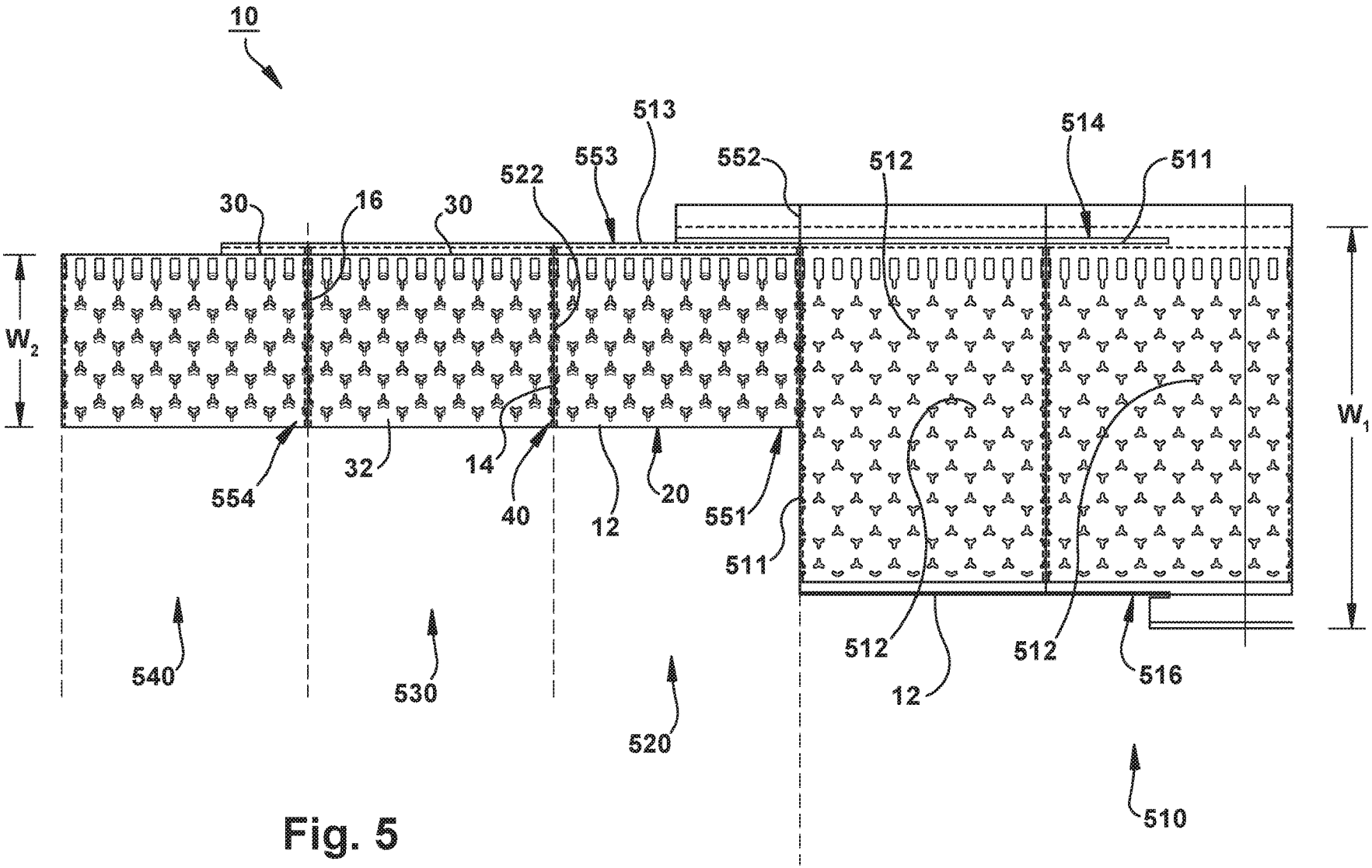
FIG. 5 is a top view of sequential assembly stages of a method to make an exemplary embodiment of an inflatable packaging web.

The web of inflatable pouches may be made from plastic film. An exemplary method for making the web 10 of inflatable pouches is illustrated in FIG. 5. At a first position 510, two single layers of material are placed on top of one another. The single layers may be plastic and, as shown, have a width W1. An exemplary width may be 20 inches, but any width may be used to accommodate a desired pouch width. The two layers may be of any of the web materials identified in any of the patents and published applications which are incorporated herein by reference. One or both of the layers may include an inflation edge line of perforations 511 that is spaced apart from the edge 513. The perforations 513 are useable to separate the preformed pouches after final assembly. Alternatively, the inflation edge line of perforations could be in line with the edge 513 or omitted. Also at position 510, the two layers are sealed together according to the seal and inflation pattern 512. In the example illustrated by FIG. 5, the seal pattern having a hexagon cell pattern and shown in FIG. 1 is used. The layers are also sealed together at top and bottom ends as indicated by arrows 514, 516, respectively. A registration perforation 552 is used for registering the two labels prior to a folding operation. In another exemplary embodiment, the illustrated single layer of inflatable material formed at position 510 is replaced with material formed in accordance with U.S. Pat. No. 6,423,166.

At position 520, the material formed at position 510 (or material formed as described in U.S. Pat. No. 6,423,166) is folded approximately in half on a fold line 551 to form a bottom edge 20 of the pouch. Cross seals 522 are formed through the four layers (two layers from the top set of layers and two layers from the bottom set of layers) to form the pouches 12. Also at position 520, a trim line 553, for example, by hot knife, is added to remove excess material.

The web may be inflated at the next portion 530. A rotary knife perforation 554 may be added to allow for separation after final assembly steps. In one embodiment, the web of inflatable pouches 10 may be shipped to a site where items are packaged. At that site, the web 10 may be inflated after packaging of the product to form inflated pouches. In the practice of the invention, the pouch may alternatively be loaded with a product after the inflation and sealing that maintains inflation. The top of the pouch is sealed after any product is loaded. Following position 530, position 540 represents a different location where the web 10 is inflated and sealed to maintain the inflation of the pouches 50. The web of inflatable pouches 10 is packaging, for example, rolled up or folded into a box. For example, the web 10 can be inflated and sealed to maintain inflation of the pouches in any one of the manners disclosed by U.S. Pat. Nos. 8,357,439, 8,038,348, 7,513,090 and Published Application No. 2009/029342.

Figure 6B:
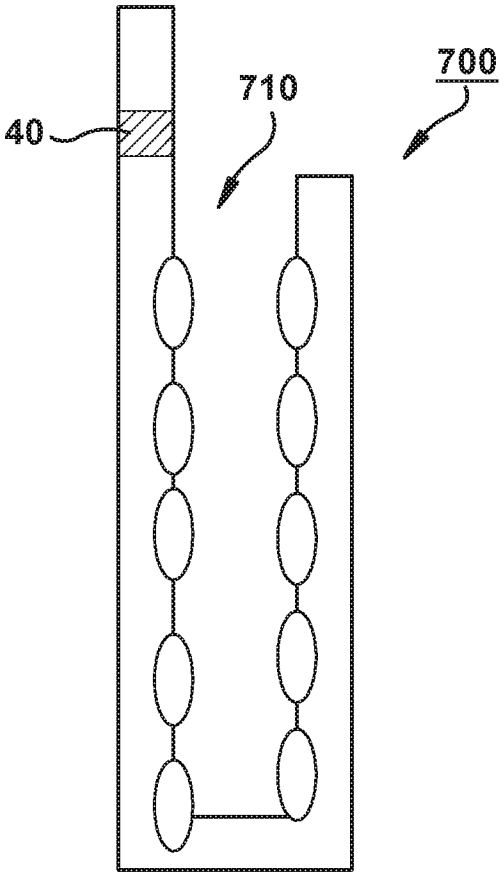
FIG. 6*b* is a sectional view of the pouch of FIG. 6*a*, showing the pouch in a sealed condition.
Figure 6A:
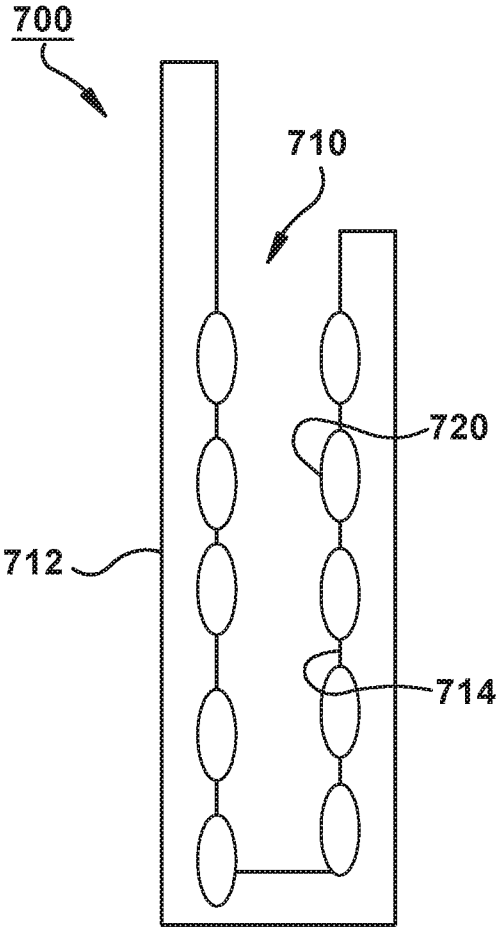
FIG. 6*a* is a sectional view of another exemplary embodiment of an inflatable packaging web, showing a pouch in an inflated condition.

Another exemplary embodiment of a packaging web is shown in FIGS. 6*a* and 6*b*. The embodiment illustrated is similar to the embodiment illustrated by FIGS. 1 and 2. As illustrated, a separate outer skin is not used. In FIG. 6*a*, the inflatable packaging web 700 has been formed by two layers, an outside layer 712 and an inside layer 714, to form an opening 710. The inside layer has a pattern of inflated cells 720 formed by a inflation process, as discussed herein. The outside layer 712 is relatively smooth and unaffected by the inflation process.

In FIG. 6*b*, the seals 40 are closed to maintain the inflation in the pouch. As discussed herein, the panels may be made from the web disclosed in U.S. Pat. No. D596,031 or the web disclosed in U.S. Pat. No. 6,423,166, each of which are incorporated herein by reference in their entirety.

Figure 7:
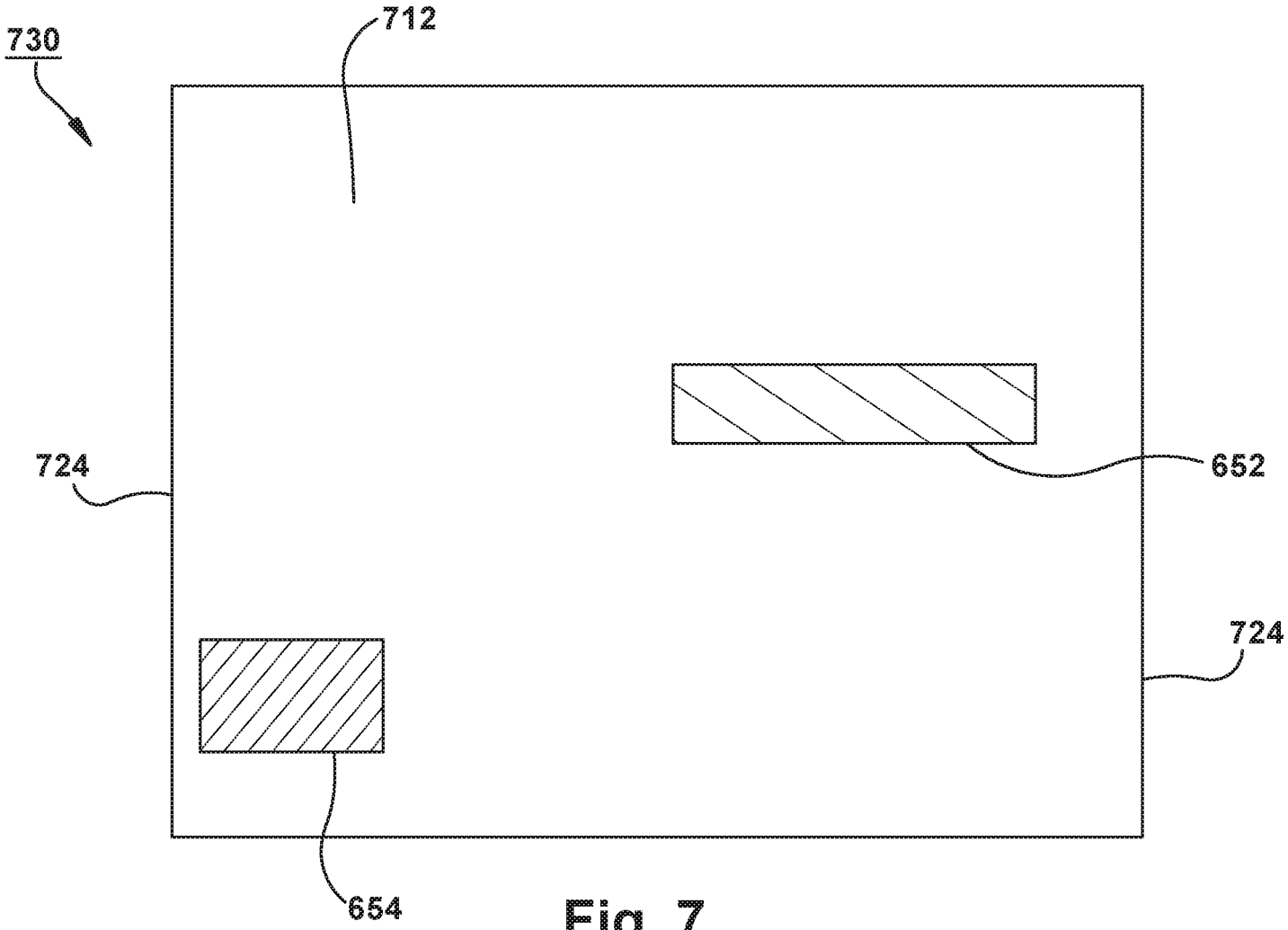
FIG. 7 is a front view of the pouch of FIG. 6*b*, showing bar code data and indicia imprinted on the pouch.

In FIG. 7, only a single pouch of the packaging web 700 is shown. The pouch 730 is defined in part by side edges 724. As discussed, the outside layer 712 is relatively smooth and unaffected by the inflation process. The outside layer 712 includes imprinted information on the relatively smooth surface, such as for example, bar code date 654 and packaging indicia 652.

In an embodiment, the web may include an outer skin separate from the inflation layers. The outer skin may be made of any thin material of suitable strength, such as for example, paper or plastic, and the material may be printable. The outer skin remains sufficiently smooth after all manufacturing steps, such as for example, initial inflation, flattening, and re-inflation, so that the bar coding is readable by a scanner. The outer skin may be sealed on all four sides around the perimeter of the preformed pouch. If the end user of the on-demand inflatable packaging produces packaging as an end product, such as for example, a padded mailer envelope, the outer skin may be sealed on only three sides around the perimeter of the envelope to allow for depositing of a product. The open side may include user sealable features, such as for example, a removable strip which temporarily protects an adhesive strip.

An embodiment of the invention having an outer skin will now be discussed. The packaging web shown in FIGS. 8*a*-11*b* has an outer skin 612. FIG. 8*a* is a top view of inflatable packaging web 610, a sectional view of the inflatable packaging web 610 is shown along the center of a pouch in FIG. 8*b*, and a sectional view of the inflatable packaging web 610 is shown along the side edge of a pouch in FIG. 8*c*.

Figure 8C:
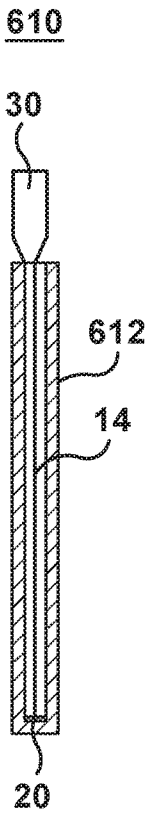
FIG. 8*c* is a sectional view of the inflatable packaging web of FIG. 8*a*, shown along the line 8*c*-8*c* of FIG. 8*a;*
Figure 8B:
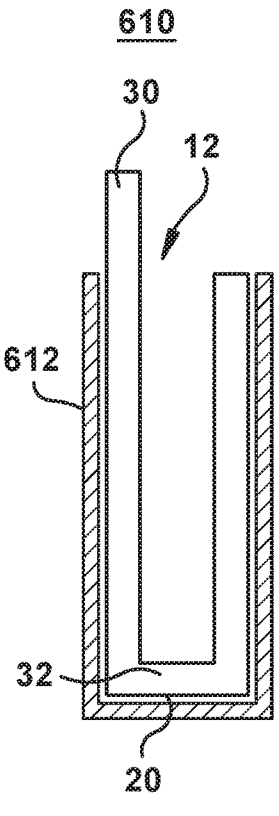
FIG. 8*b* is a sectional view of the inflatable packaging web of FIG. 8*a*, shown along the line 8*b*-8*b* of FIG. 8*a;*
Figure 8A:
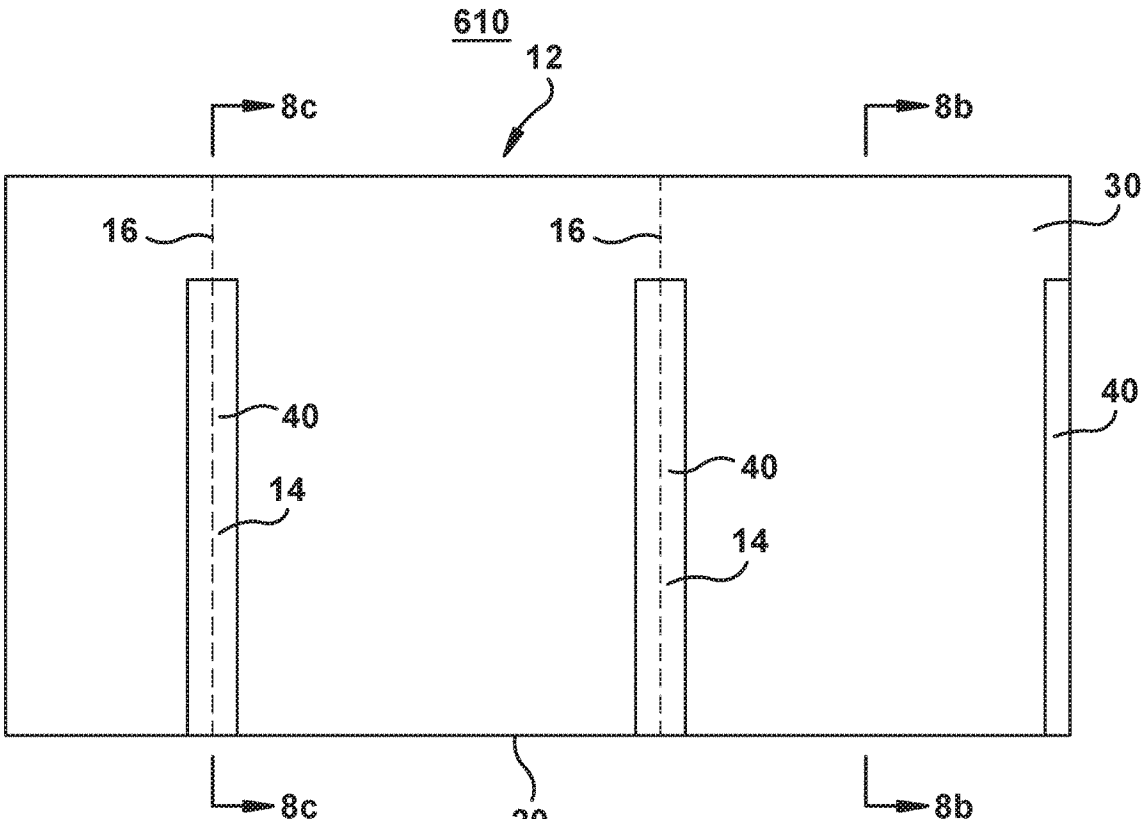
FIG. 8*a* is a front view of another exemplary embodiment of an inflatable packaging web.

The embodiment illustrated in FIGS. 8*a*-8*c* is similar to the embodiment illustrated by FIGS. 6*a* and 6*b*, except the packaging web 610 includes an outside skin 612. The outside skin 612 may be provided around the entire web as shown or adhered to one or both of the panels 18. The packaging web 610 includes a string of side connected inflatable pouches 12 with the skin 612 disposed around the pouches 12. Each pouch 12 includes at least one inflatable panel 18. The inflatable panel can take a wide variety of different forms. In exemplary embodiments, the panels 18 are made from the web disclosed in U.S. Pat. No. D596,031 or the web disclosed in U.S. Pat. No. 6,423,166, each of which are incorporated herein by reference in their entirety. Each pouch 12 is formed by sealing a pair of panels 18 together along a bottom edge 20 and side edges 14 or by folding a larger panel in half along the bottom edge and sealing the side edges together.

Referring now to FIGS. 8*b* and 8*c*, sectional views of the packaging web of FIG. 8*a* are shown. In the illustrated embodiment, outside skin 612 is only connected to the panels at the side edges 14, preferably by the seals 40. This structure may be the case when the skin 612 is disposed completely around the pouches 12 as shown, when the skin is connected to one side of the web, but not to the other, or when separate skins are attached to opposite sides of the web 610. By attaching the skin 610 to the web along the side edges 14, the skin will wrinkle less when the pouches are inflated, as compared to a skin that is attached to the entire surface(s) of the web 610. The skin 612 attached in this manner will not wrinkle significantly, if the web is made from a vacuum process as disclosed in U.S. Pat. No. 6,423,166. In another exemplary embodiment, the skin 612 is attached, adhered, or bonded to an entire surface or substantially all of the surface of the panels.

One or both of the panels 18 include an inflation channel 30. In the illustrated embodiment, only one inflation channel 30 is included and the two panels of the pouch are in fluid communication, such that inflation of one of the panels inflates the other panel. For example, in the illustrated embodiment in FIGS. 8*a*-8*c*, passages 32 connect the air pockets 34 at the bottoms of the panels to one another such that inflation through the inflation channel 30 causes inflation of both panels. The inflation channel 30 may be as described by any one or more of U.S. Pat. Nos. 6,423,166; 8,357,439; D646,972, 8,038,348, each of which are incorporated herein by reference in their entirety.

Figure 10:
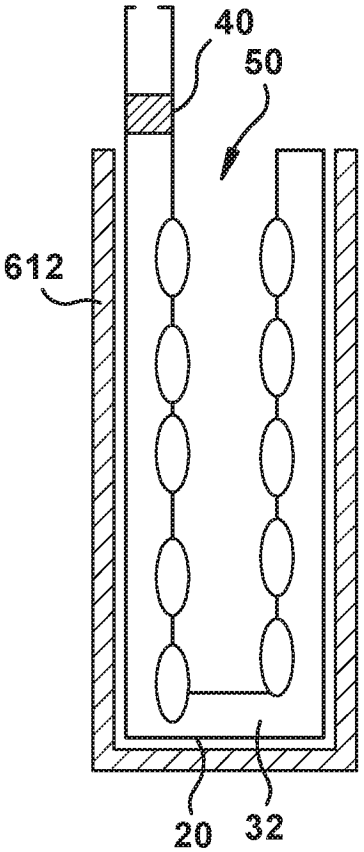
FIG. 10 is a sectional view of the pouch of FIG. 9, showing the pouch in an inflated condition with the panel sealed.
Figure 9:
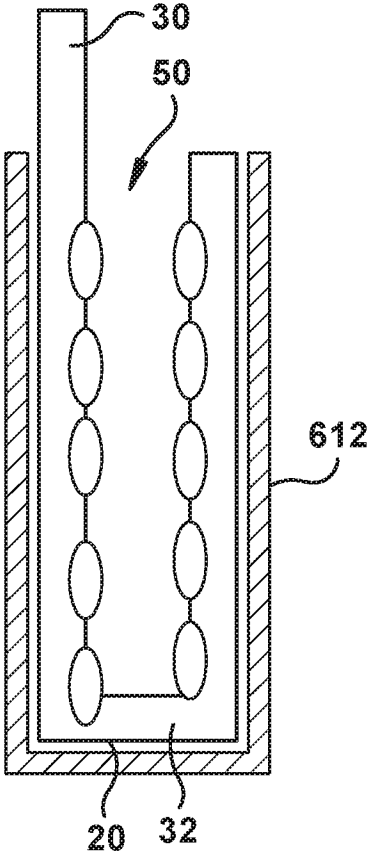
FIG. 9 is a sectional view of the inflatable packaging web of FIG. 8*a*, showing a pouch in an inflated condition.

An exemplary inflation of the web 610 is illustrated in FIGS. 9-11*b*. Referring now to FIG. 9, the web 10 is inflated through the inflation channel 30. As shown in an inflated condition, the cushioning bubble pattern of the pouches is opened by inflation on the inward side of the pouch. FIG. 10 illustrates that one of the panels is sealed across seals 40 to form and seal the inflated pouches 50 inside the skin 612. The inflatable web of pouches 610 can be inflated and sealed in a wide variety of different ways. For example, the web 10 can be inflated and sealed in any one of the manners disclosed by U.S. Pat. Nos. 8,357,439, 8,038,348, 7,513,090 and Published Application No. 2009/029342.

Figure 11A:
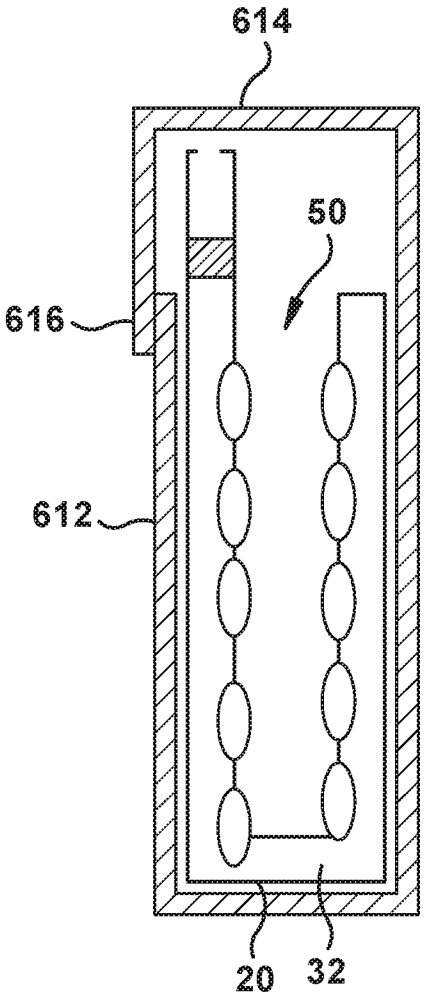
FIG. 11 *a* is a sectional view of another exemplary embodiment of an inflatable packaging web, showing a pouch in an inflated condition with the panel sealed and with the skin closed.
FIG. 11*b* is a front view of the pouch of FIG. 11*a*, showing bar code data and indicia imprinted on the pouch.

Referring to FIG. 11*a*, in one exemplary embodiment, the skin 612 is longer on one side of the pouch to form a sealing flap 614. The inflated pouch 50 may be loaded with a product, either by a packer or a consumer, the sealing flap 614 is moved to a closed position on an opposing side of the pouch, and the sealing flap 614 is positioned to seal the package at an overlap position 616. Other sealing structure for the outer skin may be used in the practice of this invention, such as for example, two flaps on each side of the pouch of equal length that are joined together, such as for example, by a strip of adhesive on an inward side of at least one flap.

Figure 11B:
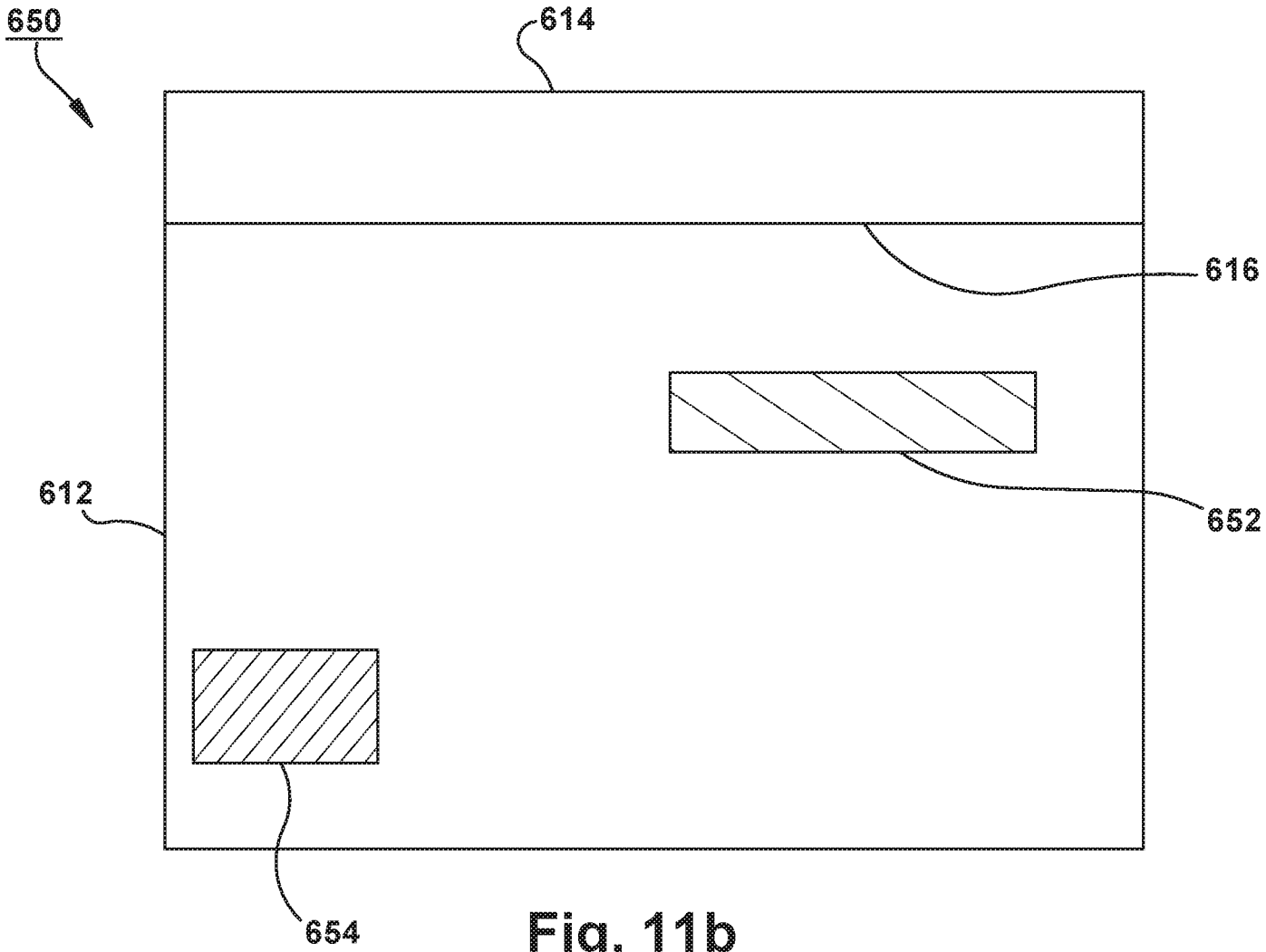

The front view of one package of the web of FIG. 11*a* is shown in FIG. 11*b*. The package 650 includes an outer skin 612 and the sealing flap 614, which is positioned to seal the package at an overlap position 616. Bar code data 654 and product indicia 652 are imprinted onto the outer skin 612. The imprinted operation may take place before or after inflation of the web, and before or after depositing of product by a packer.

Another exemplary embodiment of a packaging web is illustrated in FIGS. 12-20. The exemplary packaging web is similar to the embodiment illustrated by FIGS. 6-8, except the outer skin is sealed to close the pouch before final inflation of the web. The web may be at least partially inflated before the outer skin is sealed. If so, the web may be partially flattened prior to sealing the outer skin.

Figure 14:
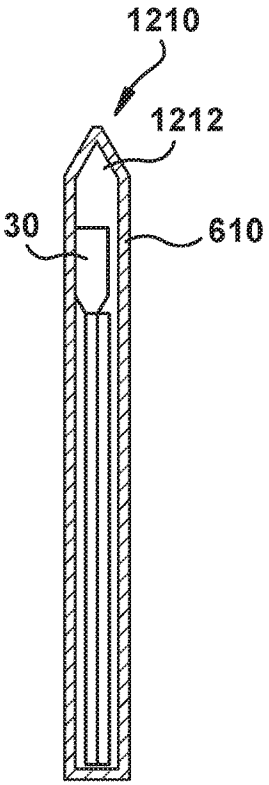
FIG. 14 is a sectional view of the inflatable packaging web of FIG. 12, shown along the line 14-14 of FIG. 12.
Figure 13:
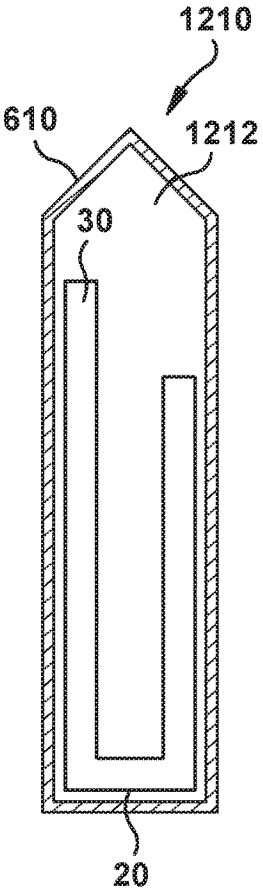
FIG. 13 is a sectional view of the inflatable packaging web of FIG. 12, shown along the line 13-13 of FIG. 12.
Figure 12:
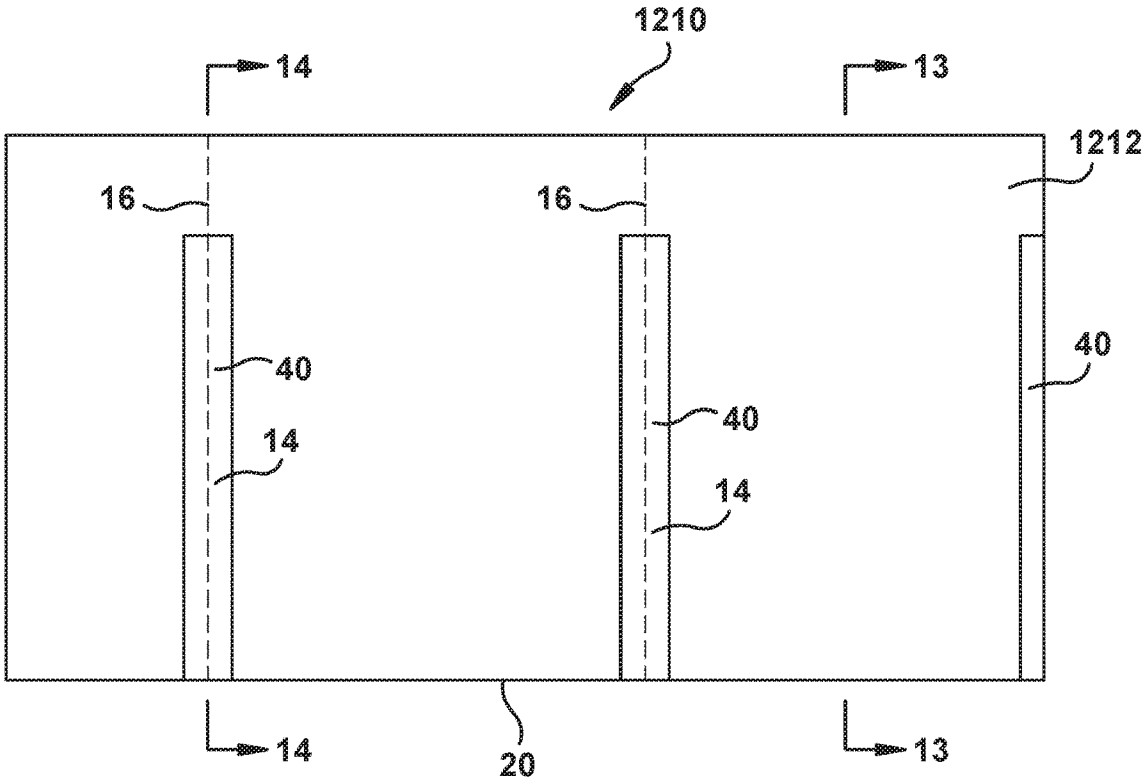
FIG. 12 is a front view of another exemplary embodiment of an inflatable packaging web.

In the embodiment illustrated in FIGS. 12-14, a top edge of the skin 610 is connected to form an enclosed channel 1212, as shown in FIGS. 13 and 14. In FIG. 13, the inflatable packaging web 1210 is shown along the middle of a pouch. In FIG. 14, the inflatable packaging web 1210 is shown along the edge line 14 of the pouch. In a non-inflated and stored configuration, the entire web may be at least partially flatten.

Depositing a product in the preformed pouches of the web will now be discussed. In the practice of this invention, a product may be deposited into the pouch by several different ways. For example, the product may be inserted into the open end of the pouch, either by manual or by automated techniques. The product can be inserted into the open end before the pouch is inflated and sealed. Alternatively, the product can be inserted into the pouch through the open end and the pouch is inflated and sealed. A packer may select one of these options, in view of the product size, weight, or other characteristics.

The exemplary skin configuration of FIGS. 12-14 allows the packaging web 1210 to be opened, loaded, closed and sealed by a packaging machine, such as the packaging machine 1210 illustrated in FIGS. 21 *a* and 21 *b*. Examples of packaging machines that can be modified, or combined, to open, load, close, and seal the outer skin are described in U.S. Pat. Nos. 7,552,571; 6,170,238; 6,055,796; 5,996,319; 5,987,856; and 5,944,424, and US Publication No. 2012/0214658, each of which are incorporated herein by reference in their entirety. Other skin configurations may be used in the practice of this invention to load, close and seal a padded package by a packaging machine.

In one exemplary embodiment, a bagging machine is used to load, close and seal a padded package by a packaging machine. In this example, the pouch is loaded with a product, and the outer skin is sealed. For example, the pouch, loaded with a product, may be placed in a mailing bag. In one exemplary embodiment, a pouch loaded with a product is placed in a bag and the bag is sealed with a bagging machine. For example, a pouch loaded with a product may be bagged using any one of the machines disclosed by U.S. Pat. Nos. 83,076,617; 7,7552,257; 6,948,296; 6,742,317; 6,543,201; 6,055,796; 5996,319; 5,987,856; 5,944,424 and 6,170,238, each of which are incorporated herein by reference in their entirety.

Another exemplary method of using an inflated packaging web to package a product will now be discussed. FIGS. 15-20 illustrate a method of forming an inflated/padded package 1500 from the web 1210 with the packaging machine.

Figure 17:
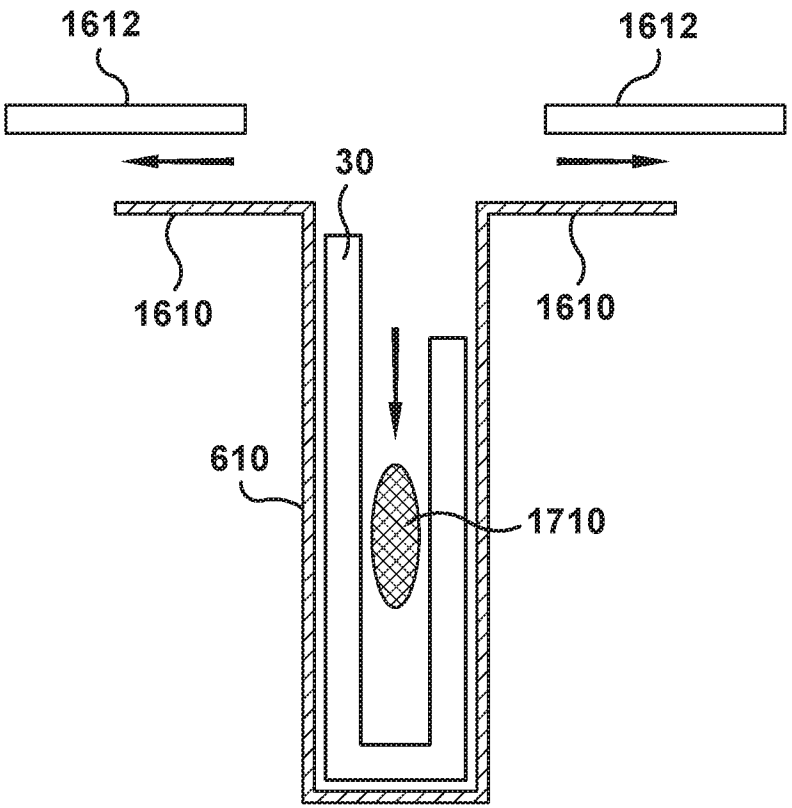
FIG. 17 is a sectional view of the inflatable packaging web of FIG. 13, showing a product inserted inside.
Figure 16:
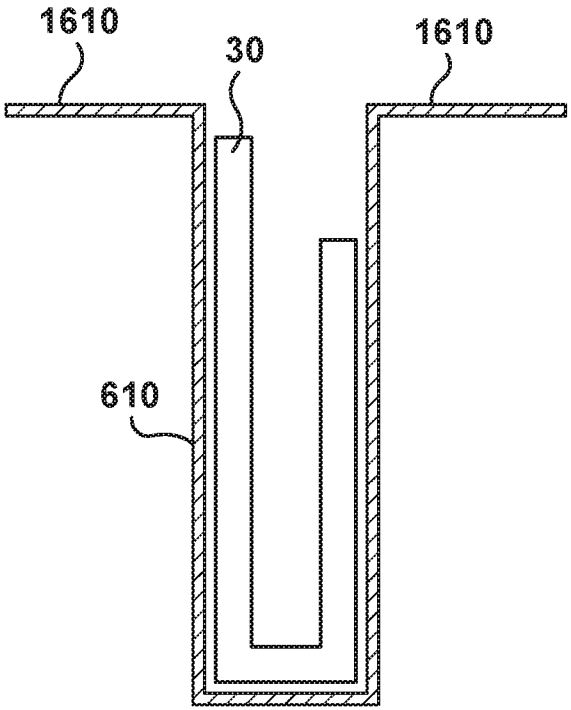
FIG. 16 is a sectional view of the inflatable packaging web of FIG. 13, showing the sealed skin in a slit condition and the skin flaps folded open.
Figure 15:
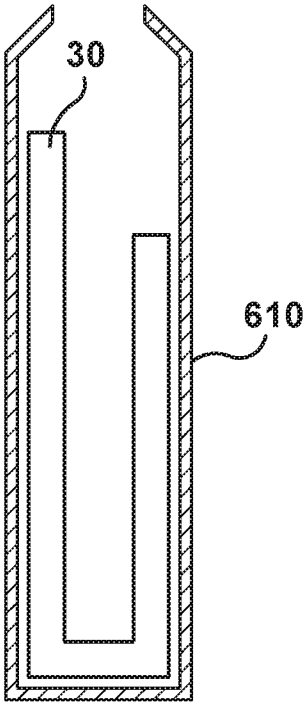
FIG. 15 is a sectional view of the inflatable packaging web of FIG. 13, showing the sealed skin in a slit condition.

Referring to FIG. 15, a top of the skin 610 is cut, slit, or otherwise separated. The machine makes the slit, cut, or other separation in the same manner as is disclosed in U.S. Pat. Nos. 7,552,571; 6,170,238; 6,055,796; 5,996,319; 5,987,856; or 5,944,424. Referring to FIG. 16, top lips 1610 are formed and grabbed by belts 1612. The belts travel the same direction as the web and act to pull the web in the forward direction through the machinery. The belts 1612 may have the same form disclosed by U.S. Pat. Nos. 7,552,571; 6,170,238; 6,055,796; 5,996,319; 5,987,856; or 5,944,424. Referring to FIG. 17, the belts 1612 pull the lips apart to open the pouch. A product 1710 is deposited into the pouch. The depositing of the product may be done by automated machinery or manually by hand.

Figure 20:
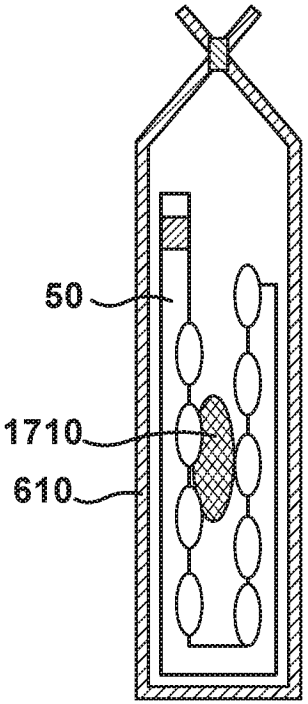
FIG. 20 is a sectional view of the inflatable packaging web of FIG. 19, showing the skin flaps closed.
Figure 19:
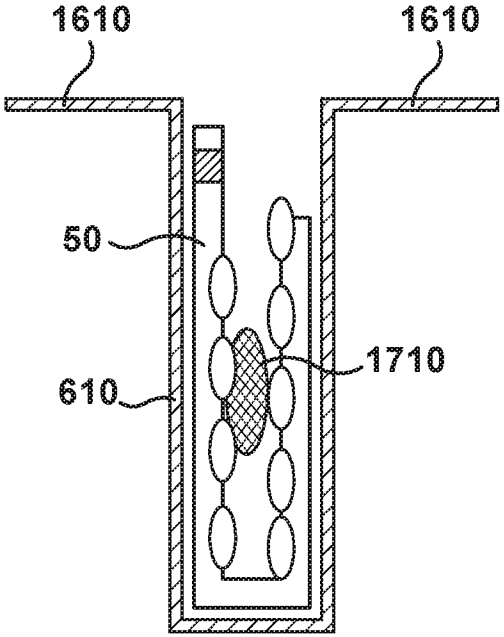
FIG. 19 is a sectional view of the inflatable packaging web of FIG. 18, showing the web in an inflated condition and the panel sealed.
Figure 18:
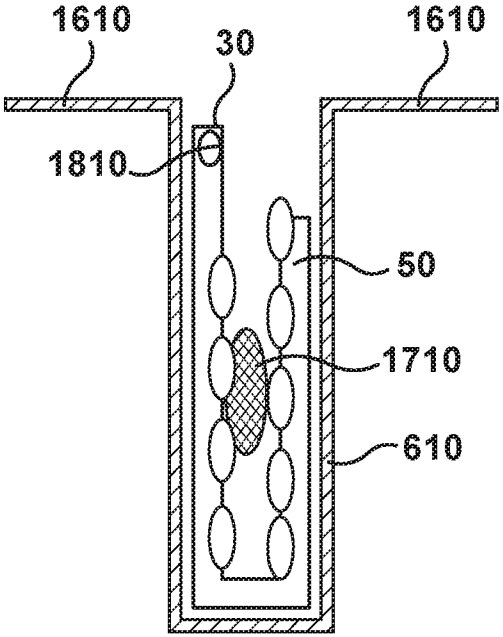
FIG. 18 is a sectional view of the inflatable packaging web of FIG. 17, showing the web in an inflated condition.

FIGS. 18-20 illustrate an exemplary process for finishing the packaging of a product. FIG. 19 is a sectional view showing the web 610 being inflated around a product 1710. The web may be inflated by a inflation nozzle 1810 into a inflation channel 30. After inflation, the web may be sealed by sealing the web at the seals 40 to maintain the inflation. FIG. 20 illustrates the flaps 1610 of the outer skin in a sealed position. Once the web 610 reaches this condition, the individual packages may be separated from the web, such as for example, by separating at edge perforations.

Figure 21A:
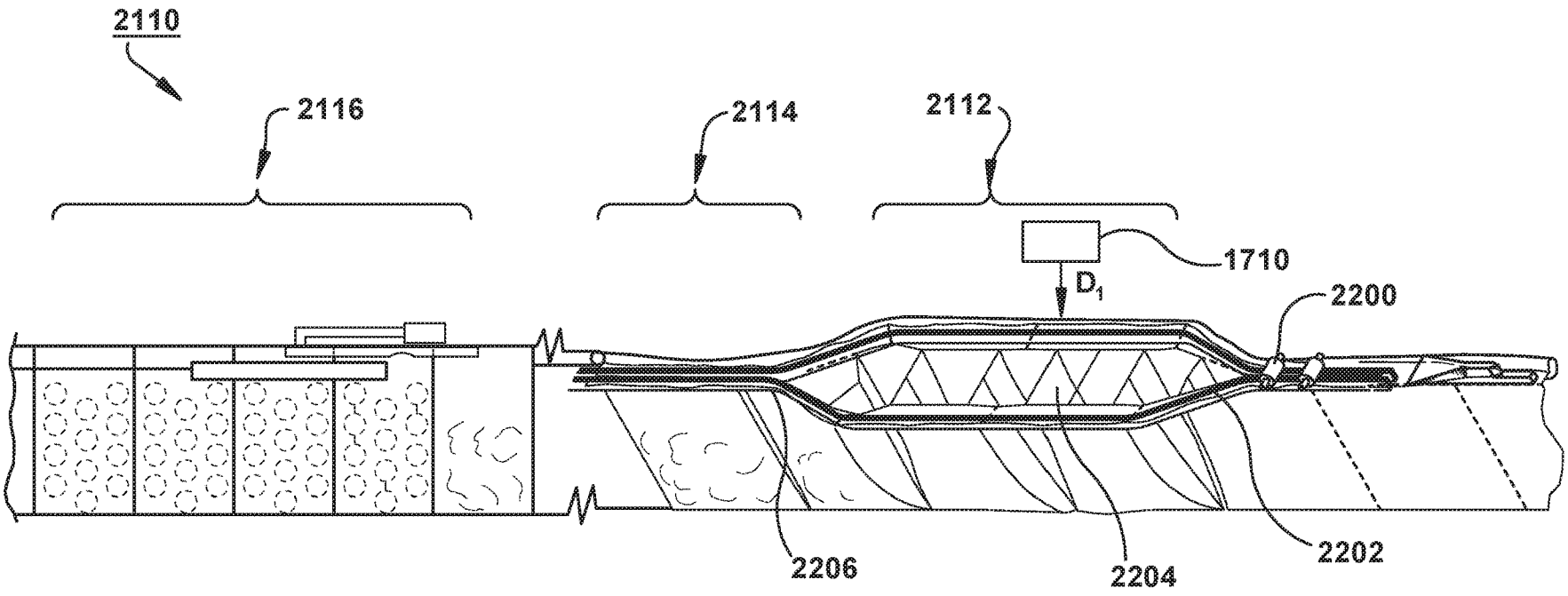
FIG. 21*a* is a front perspective view of a packaging machine, showing exemplary machinery for forming and packaging a padded package from an inflatable packaging web.
Figure 21B:
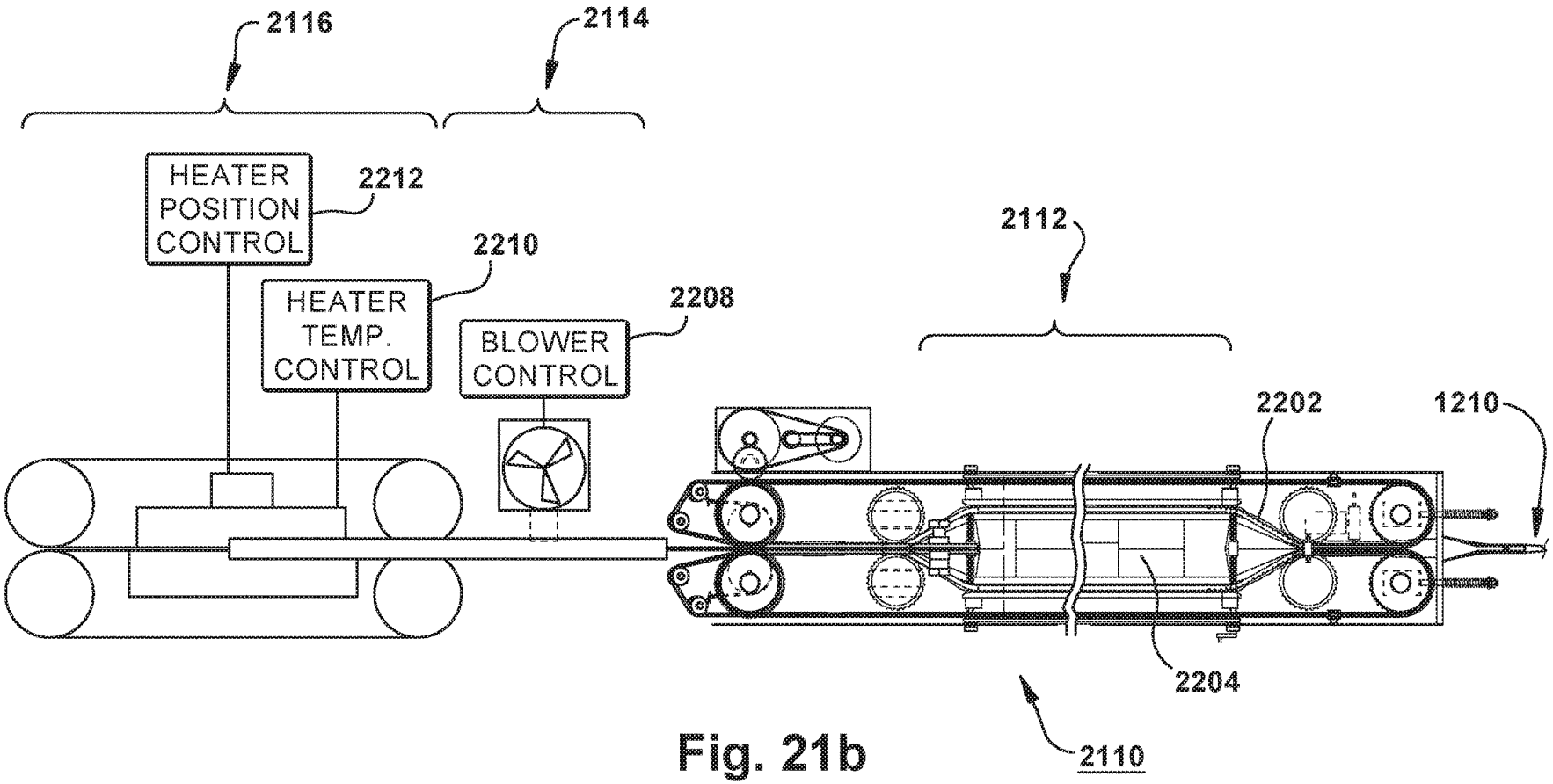
FIG. 21*b* is a top view of a packaging machine of FIG. 21*a;*

Referring to an exemplary embodiment illustrated in FIGS. 21*a* and 21*b*, the packaging machine 2110 includes several stations. Each station performs one or more particular purposes as the web travels through each station. For example, the packaging machine 2110 includes a load station 2112, an inflation and sealing station 2114, and a skin sealing station 2116. It will be apparent to one skilled in the art that packaging machine 2110 is offered for exemplary purposes only, and that the invention may be practiced with other packaging machines, or with a combination of packaging machines and one or more manual assembly steps.

Referring to FIG. 21*a*, a packaging web 1210 is moved along a path of travel toward a load station 2112. The load station is used to deposit automatically one of more pieces of product into each pouch of the web 1210. At the beginning of the load station, or upstream from it, the enclosed channel 1212 (see FIGS. 13-15) is cut open. At a separation point 2220, the flaps 1610 are engaged and pulled apart by belts, which also pull the web through the machinery. The outsides of the web travels outward along an angled path 2202 prior to a loading point. The load station 2112 may correspond to a load station disclosed in U.S. Pat. Nos. 7,552,571; 6,170,238; 6,055,796; 5,996,319; 5,987,856; or 5,944,424.

The load station 2112 includes a length of travel in which the two panels are held apart a distance. In the length of travel, a loading cavity 2204 is created in between the panels of each pouch. As shown in FIGS. 21*a* and 21*b*, the product 1710 is deposited a direction D1 into the loading cavity by load station 2112. As discussed herein, the loading may be by automated machinery or by a manual step. At the end of the loading station 2012, the sides of the panel or brought back together to be contiguous or relatively contiguous at a pre-sealing point 2206.

The web travels on to the next station to be inflated and sealed. In an exemplary embodiment, inflation and sealing components 2114 correspond to inflation and sealing components disclosed by U.S. Pat. Nos. 8,357,439, 8,038,348, 7,513,090 or Published Application No. 2009/029342 and are provided after the load station 2112. The web includes a channel for the pouches to be inflated. Referring specifically to FIGS. 18 and 21, the channel 30 is routed onto a pin which includes an inflation nozzle 1810. The pin and inflation nozzle 1810 slides into the channel as the web travels through the machinery and inflates the pouch around the product by a blower 2208. As shown in FIG. 19, the pouch is then sealed along the seals 40 to maintain inflation of the pouch. This sealing may be preformed by sealing belts that have the configuration of sealing belts disclosed by U.S. Pat. Nos. 7,552,571; 6,170,238; 6,055,796; 5,996,319; 5,987,856; or 5,944,424. In one exemplary embodiment, the pouches of the web are vacuum formed, such as for example, by using the material disclosed by U.S. Pat. No. 6,423,166.

In the illustrated embodiment, a skin sealing station 2116 is positioned after the inflation and sealing components 2114. Still referring to FIGS. 21*a* and 21*b*, the outer skin is sealed by sealing belts. The sealing is controlled by a heater temperature control 2210 and a heater position control 2212. The sealing belts may have the configuration of the sealing belts of U.S. Pat. Nos. 7,552,571; 6,170,238; 6,055,796; 5,996,319; 5,987,856; or 5,944,424.

In another exemplary embodiment, the sealing of the pouches and the sealing of the skins is accomplished with a single seal. For example, after inflation of the pouches a single sealer would seal across all four layers, i.e., the two layers at the end of the pouch and two layers of the skins 1610, at the same time. In one exemplary embodiment, the skin sealing station 2116 corresponds to a closure and sealing station disclosed by U.S. Pat. Nos. 7,552,571; 6,170,238; 6,055,796; 5,996,319; 5,987,856; or 5,944,424.

Figure 22:
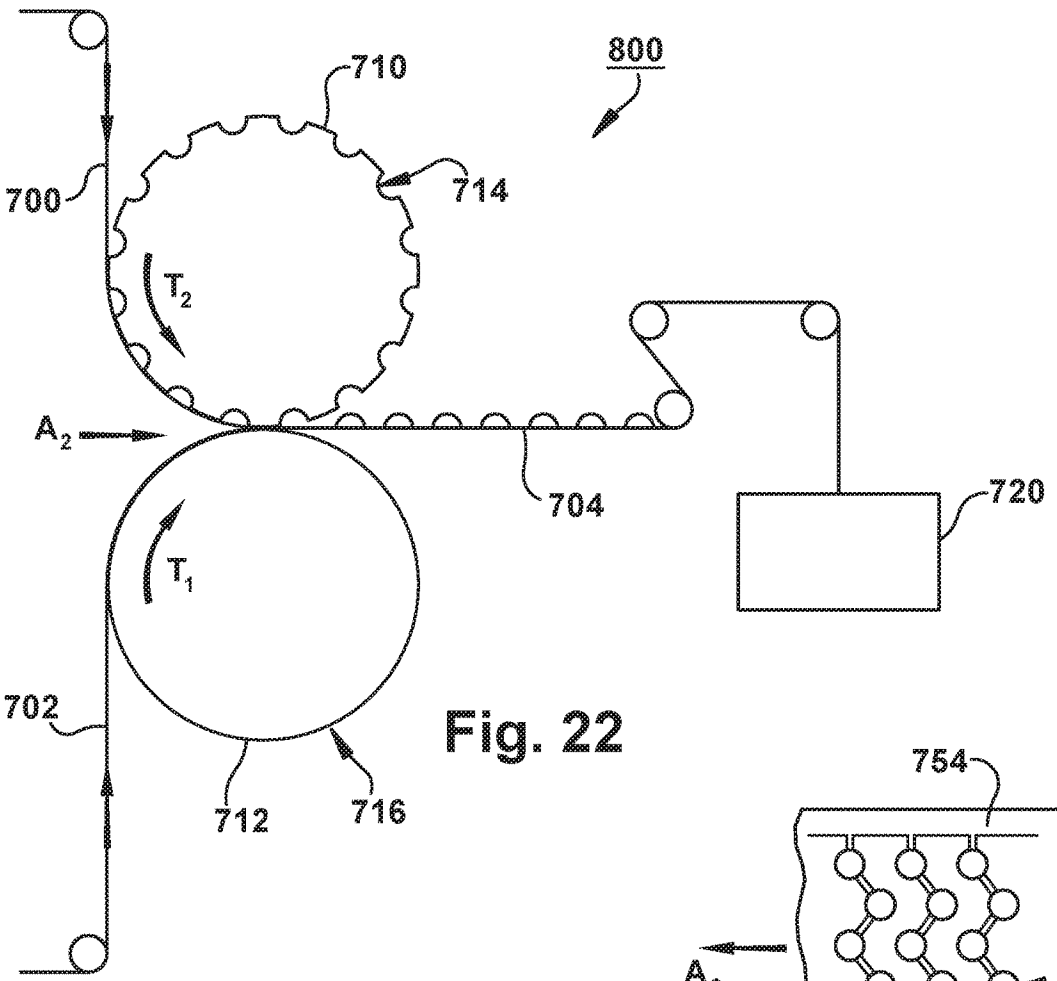
FIG. 22 is a schematic view of a process of forming inflatable cushioning material.

A machine and method for producing inflatable material is illustrated in FIG. 22. The method is useable for forming re-inflatable material that can be used to product cushioning material in any of the embodiments disclosed by this application. As discussed, the web of preformed pouches may be of a variety of forms in the practice of the invention. The web may be an inflatable cushioning material designed to be inflated at a later time by an end user. An exemplary material is described in U.S. Pat. No. 6,423,166. The end user inflates this material on-demand and inflates only the amount of wrapping material that is required at that time.

Still referring to FIG. 22, a machine 800 is arranged to produce an inflatable cushioning material. The machine includes two adjacent wheels, a base wheel 712 rotating in a direction T1 and a forming wheel 710 rotating in an opposite direction T2. Two individual layers of plastic film 700, 702 are pulled in a direction A2 between the two wheels 710, 712. The forming wheel 710 has a patterned surface 714 to produce an inflatable pattern on the web 704. The base wheel 712 may have a smooth surface 716. The inflatable cushioning material may be stored in bulk amounts in a container 720 in non-inflated form until an end-user is ready to use the material. Another machine or series of machine can attached the outer skin and inflate the cushioning material in an amount desired.

Figure 23:
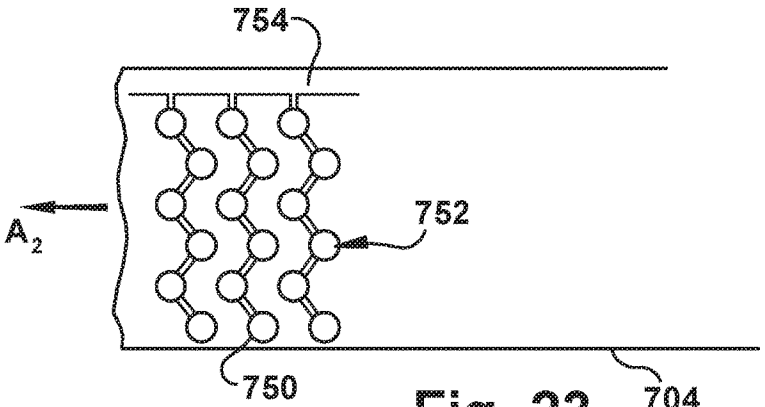
FIG. 23 is a top view of a web of inflatable cushioning material being produced by the process of FIG. 22.

A top view of the web 704 of inflatable cushioning material is shown in FIG. 23. The web includes an inflation pattern 750 which includes a repetitive of individual cells 752 arranged in an alternating pattern. After an inflation process, such as by vacuum, the cells may have a distinguishable shape, such as for example, hexagonal. The patterned web may shrink in both longitudinal and lateral directions to form the inflated pattern. Any separate outer skin may be attached to the inflatable cushioning material at the edges only to minimize shrinkage or distortion.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof. Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, circuits, devices and components, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A packaging material comprising:

a web of pouches defined by side edges, a first panel, and a second panel, wherein at least one of the first and second panels has an inflation pattern, wherein the inflation pattern of each of the pouches is uninflated such that the web is in a non-inflated state, wherein the web has a continuous inflation channel that is in fluid communication with the inflation pattern of each of the pouches; and an outer skin attached to an outside of the web, wherein, when the web is in the non-inflated state, each of the pouches of the web is configured to be inflated by inflating the inflation pattern of the pouches with the outer skin already attached to the outside of the web, wherein a first layer of the outer skin is attached to the first panel of the pouches and a second layer of the outer skin is attached to the second panel of the pouches, wherein the outer skin is attached to the web only along edge lines of the pouches, wherein the outer skin is detached from the web between the edge lines of the pouches, and wherein the outer skin is attached to the outside of the web such that the continuous inflation pattern extends above the outer skin.

2. The packaging material of claim 1, further comprising:

a seal formed in the pouches after the pouches are in the inflated state such that the seal maintains the pouches in the inflated state.

3. The packaging material of claim 2, wherein the web is separable into a plurality of padded envelopes after the seal is formed in the pouches.

4. The packaging material of claim 2, wherein the seal is in both the pouches and the outer skin such the seal closes both the pouches and the outer skin.

5. The packaging material of claim 2, further comprising:

at least one product deposited in one of the pouches;

wherein, after the inflation pattern of the one of the pouches is in the inflated state and the pouch is separated from the web, the one of the pouches and the outer skin attached to the one of the pouches forms a padded envelope that contains the at least one product.

6. The packaging material of claim 5, wherein a seal closes both the one of the pouches and the outer skin attached to the one of the pouches with the at least one product contained therein.

7. The packaging material of claim 1, wherein the first and second panels are positioned to define an open end and a closed end.

8. The packaging material of claim 1, wherein the pouches are plastic pouches.

9. The packaging material of claim 1, wherein the pouches are preformed pouches.

10. The packaging material of claim 1, wherein the outer skin is a plastic outer skin.

11. The packaging material of claim 1, wherein, the web is arranged in a stored configuration when the web is in the non-inflated state and after the outer skin is attached to the web.

* * * * *